US011365955B2

(12) United States Patent
Downing et al.

(10) Patent No.: US 11,365,955 B2
(45) Date of Patent: Jun. 21, 2022

(54) APPARATUS FOR HINDERING VEHICULAR MOVEMENT

(71) Applicant: Event Crowd Control Inc., Burlington (CA)

(72) Inventors: George Schoales Samuel Downing, Burlington (CA); George Vujnovic, Toronto (CA); Michael Starogiannis, Oakville (CA)

( * ) Notice: Subject to any disclaimer, the term of this patent is extended or adjusted under 35 U.S.C. 154(b) by 127 days.

(21) Appl. No.: 16/864,194

(22) Filed: May 1, 2020

(65) Prior Publication Data

US 2020/0393219 A1 Dec. 17, 2020

Related U.S. Application Data

(60) Provisional application No. 62/851,300, filed on May 22, 2019.

(51) Int. Cl.
*E01F 13/12* (2006.01)
*F41H 11/08* (2006.01)
*F41H 5/24* (2006.01)

(52) U.S. Cl.
CPC ..... *F41H 11/08* (2013.01); *E01F 13/12* (2013.01); *F41H 5/24* (2013.01)

(58) Field of Classification Search
CPC ..... F41H 5/24; F41H 11/08; E01F 13/12
USPC ..... 404/6; 49/49
See application file for complete search history.

(56) References Cited

U.S. PATENT DOCUMENTS 4,367,975 A * 1/1983 Tyers ..... E01F 13/04 404/11
4,861,185 A 8/1989 Eikelenboon
5,228,237 A 7/1993 Nasatka
5,248,215 A * 9/1993 Fladung ..... E01F 9/40 404/6
5,704,730 A * 1/1998 Burton-Chambers ..... E01F 13/123 404/6
6,702,512 B1 * 3/2004 Reale ..... E01F 13/123 404/6
7,118,304 B2 * 10/2006 Turpin ..... E01F 13/08 404/6
7,128,496 B2 * 10/2006 Rogers ..... E01F 13/12 404/7

(Continued)

FOREIGN PATENT DOCUMENTS

GB 2433285 A 1/2006
WO 2007105940 9/2007

OTHER PUBLICATIONS

Author unknown, Anti Truck-Ram Barriers, retrieved Nov. 26, 2018 from https://titansecurite.com/en/anti-truck-ram/, 6 pages.

(Continued)

*Primary Examiner* — Raymond W Addie
(74) *Attorney, Agent, or Firm* — Aird & McBurney LP

(57) ABSTRACT

An apparatus includes a base assembly positionable on a work surface. A first elongated member is pivotally coupled to the base assembly. A second elongated member is affixed to the first elongated member. The second elongated member is configured to pivotally move and intimately contact a vehicle, and to hinder movement of the vehicle over and past the base assembly in response to the vehicle pivotally moving the first elongated member, with a weight of the vehicle received by the base assembly.

24 Claims, 17 Drawing Sheets

(56) References Cited

U.S. PATENT DOCUMENTS

| | | | | |
|---|---|---|---|---|
| 7,172,176 | B1 * | 2/2007 | Eastland | E01F 13/022 256/26 |
| 7,320,557 | B1 | 1/2008 | Potter | |
| 7,850,391 | B2 * | 12/2010 | Omar | E01F 13/12 404/6 |
| 8,128,310 | B2 | 3/2012 | Dindl et al. | |
| 8,215,866 | B2 * | 7/2012 | Whitford | F41H 5/14 404/6 |
| 9,051,699 | B2 * | 6/2015 | Rowland | E01F 15/043 |
| 10,266,999 | B2 * | 4/2019 | Rothschild | E01F 13/123 |
| 10,370,808 | B2 * | 8/2019 | Neusch | E01F 13/02 |
| 10,415,198 | B1 * | 9/2019 | Thomas | E01F 13/02 |
| 10,612,200 | B2 * | 4/2020 | Bock, II | E01F 13/04 |
| 10,988,903 | B1 * | 4/2021 | Neusch | E01F 9/685 |
| 11,149,391 | B2 * | 10/2021 | Weissberg | E01F 13/12 |
| 2003/0108387 | A1 * | 6/2003 | Airikkala | E01C 9/007 404/6 |
| 2012/0177439 | A1 * | 7/2012 | More | E01F 13/12 404/6 |
| 2014/0010591 | A1 * | 1/2014 | Ball | E01F 9/685 404/6 |
| 2019/0154407 | A1 * | 5/2019 | Neusch | E01F 13/048 |
| 2019/0161927 | A1 * | 5/2019 | Pan | E01F 13/12 |
| 2019/0316307 | A1 * | 10/2019 | Neusch | E01F 13/02 |

OTHER PUBLICATIONS

Author unknown, RAMCATCH, retrieved Nov. 26, 2018 from https://www.ramcatch.com/, 7 pages.

Author unknown, Anti Vehicle Belier, retrieved Nov. 22, 2018 from www.haltbrac-defense.fr, 6 pages.

Author unknown, Archer 1200 Anti-Vehicle Barriers, retrieved Nov. 22, 2018 from https://www.betterbarriers.com/products/archer-1200/, 3 pages.

* cited by examiner

APPARATUS FOR HINDERING VEHICULAR MOVEMENT

TECHNICAL FIELD

This document relates to the technical field of (and is not limited to) an apparatus for hindering vehicular movement and for shielding from a bomb blast emanating from a vehicle (and/or method therefor).

BACKGROUND

A shield is configured to provide, at least in part, protection against a bomb blast.

SUMMARY

Known systems do not provide, at least in part, protection from an incursion of a vehicle, and a blast therefrom.

It will be appreciated that there exists a need to mitigate (at least in part) at least one problem associated with the existing systems for hindering a vehicular movement and shielding from a bomb blast emanating from a vehicle (also called the existing technology). After much study of the known systems and methods with experimentation, an understanding (at least in part) of the problem and its solution has been identified (at least in part) and is articulated (at least in part) as follows:

What may be needed is an apparatus configured to mitigate the effect of blast emanating from a vehicle toward a protection zone (a pedestrian-safe zone). Preferably, what may be needed is an apparatus for hindering, at least in part, movement of a vehicle, and for shielding, at least in part, a pedestrian from a potential bomb blast emanating from the vehicle.

To mitigate, at least in part, at least one problem associated with the existing technology, there is provided (in accordance with a first major aspect) an apparatus. The apparatus includes and is not limited to a base assembly positionable on a work surface. A first elongated member is pivotally coupled to the base assembly. The first elongated member is pivotally movable (relative to the base assembly, also called a stationary base assembly). A second elongated member is affixed to, and extends from, the first elongated member. The second elongated member pivotally moves (relative to the base assembly) and the second elongated member and a vehicle intimately contact each other, and the second elongated member hinders, at least in part, movement of the vehicle (over and past the base assembly) once the vehicle moves toward and strikes and pivotally moves (pivots) the first elongated member (with a weight of the vehicle received, at least in part, by the base assembly); in other words, the second elongated member pivotally moves (relative to the base assembly), and the second elongated member intimately contacts the vehicle, and the second elongated member hinders, at least in part, movement of the vehicle (over and past the base assembly) in response to the vehicle moving toward and striking and pivotally moving the first elongated member (relative to the base assembly). In accordance with a preferred embodiment (option), the apparatus further comprises (includes) a plate assembly is affixed to, and extends from, the second elongated member. The plate assembly is supportive of pedestrian weight thereon. In accordance with a preferred embodiment (option), the apparatus further comprises (includes) a plate assembly is configured to shield, at least in part, a pedestrian (such as, and not limited to, from a bomb blast emanating from the underside of the vehicle or to provide light-arms protection) once the second elongated member (is pivotally moved relative to the base assembly), and the second elongated member intimately and the vehicle contact each other. A technical advantage is that the apparatus (the plate assembly) may provide a measure of shielding against the bomb blast emanating from the vehicle to the pedestrian located proximate to the plate assembly (once the bomb, which is mounted to vehicle, explodes).

To mitigate, at least in part, at least one problem associated with the existing technology, there is provided (in accordance with a second major aspect) an apparatus. The apparatus includes and is not limited to a base assembly positionable on a work surface. A first elongated member is pivotally coupled to the base assembly. The first elongated member is pivotally movable (relative to the base assembly) once the first elongated member is pivotally coupled to the base assembly. A second elongated member is affixed to, and extends from, the first elongated member. The second elongated member pivotally moves (relative to the base assembly), and the second elongated member intimately contacts a vehicle, and the second elongated member hinders, at least in part, movement of the vehicle (over and past the base assembly) in response to the vehicle moving toward and striking and pivotally moving the first elongated member (with a weight of the vehicle being received, at least in part, by the base assembly); in other words, the second elongated member pivotally moves (relative to the base assembly), and the second elongated member and the vehicle intimately contact each other, and the second elongated member hinders, at least in part, movement of the vehicle (over and past the base assembly) once the vehicle moves toward and strikes and pivotally moves the first elongated member (relative to the base assembly) with the weight of the vehicle received, at least in part, by the base assembly. The movement of the first elongated member urges the second elongated member to pivotally move (relative to the base assembly), and the second elongated member intimately contacts an underside of the vehicle, which is moving; this is done in such a way that the second elongated member hinders, at least in part, movement of the vehicle over and past the base assembly (with the weight of the vehicle being received, at least in part, by the base assembly). In accordance with a preferred embodiment (option), the apparatus further comprises (includes) a plate assembly is affixed to, and extends from, the second elongated member. The plate assembly is supportive of pedestrian weight thereon once the plate assembly is positioned coplanar relative to the work surface. In accordance with a preferred embodiment (option), the apparatus further comprises (includes) a plate assembly configured to shield, at least in part, a pedestrian (such as from a bomb blast emanating from the underside of the vehicle and/or provide light-arms protection) once the pedestrian is positioned proximate to the first elongated member, and once the second elongated member is pivotally moved (relative to the base assembly) to intimately contact the vehicle. A technical advantage is that the apparatus (the plate assembly) may provide a measure of shielding against the bomb blast emanating from the vehicle to the pedestrian located proximate to the plate assembly (once the bomb, which is mounted to vehicle, explodes).

To mitigate, at least in part, at least one problem associated with the existing technology, there is provided (in accordance with a third major aspect) an apparatus. The apparatus includes and is not limited to a base assembly positionable on a work surface. A first elongated member is pivotally coupled to the base assembly. The first elongated member is pivotally movable (relative to the base assembly), from a first alignment toward a second alignment once the first elongated member is pivotally coupled to the base assembly (in response to a vehicle moving toward and striking the first elongated member positioned in the first alignment, and urging pivotal movement of the first elongated member toward the second alignment; in other words, the first elongated member is pivotally movable (relative to the base assembly), from the first alignment toward the second alignment, once the first elongated member is pivotally coupled to the base assembly, and once the vehicle moves toward and strikes the first elongated member. A second elongated member is affixed to, and extends from, the first elongated member. The second elongated member and the first elongated member define an angle subtended therebetween. The second elongated member pivotally moves (relative to the base assembly) and intimately contacts the vehicle, and hinders, at least in part, movement of the vehicle (over and past the base assembly) in response to the vehicle moving toward and striking and pivotally moving the first elongated member (relative to the base assembly) from the first alignment toward the second alignment. The movement of the first elongated member (from the first alignment toward the second alignment) urges the second elongated member to pivotally move (relative to the base assembly) and intimately contact an underside of the vehicle, which is moving; this is done in such a way that the second elongated member hinders, at least in part, movement of the vehicle over and past the base assembly (with a weight of the vehicle being received, at least in part, by the base assembly) once the vehicle is halted by the second elongated member. In accordance with a preferred embodiment (option), the apparatus further comprises (includes) a plate assembly is affixed to, and extends from, a lateral elongated side of the second elongated member. The plate assembly is supportive of pedestrian weight thereon once the plate assembly is positioned coplanar relative to the work surface. In accordance with a preferred embodiment (option), the apparatus further comprises (includes) a plate assembly configured to shield, at least in part, a pedestrian (such as from a bomb blast emanating from the underside of the vehicle and/or provide light-arms protection, etc.), once the pedestrian is positioned proximate to the first elongated member and once the second elongated member (which pivotally moves relative to the base assembly) intimately contacts the underside of the vehicle. A technical advantage is that the apparatus (the plate assembly) may provide a measure of shielding against the bomb blast emanating from the vehicle to the pedestrian located proximate to the plate assembly (once the bomb, which is mounted to vehicle, explodes).

Other aspects are identified in the claims. Other aspects and features of the non-limiting embodiments may now become apparent to those skilled in the art upon review of the following detailed description of the non-limiting embodiments with the accompanying drawings. This Summary is provided to introduce concepts in simplified form that are further described below in the Detailed Description. This Summary is not intended to identify potentially key features or possible essential features of the disclosed subject matter, and is not intended to describe each disclosed embodiment or every implementation of the disclosed subject matter. Many other novel advantages, features, and relationships will become apparent as this description proceeds. The figures and the description that follow more particularly exemplify illustrative embodiments.

DETAILED DESCRIPTION OF THE DRAWINGS

The non-limiting embodiments may be more fully appreciated by reference to the following detailed description of the non-limiting embodiments when taken in conjunction with the accompanying drawings, in which:

FIG. 1, FIG. 2, FIG. 3 and FIG. 4 depict side views of embodiments of an apparatus (also called a shield assembly or a vehicular barricade); and FIG. 5 and FIG. 6 depict perspective views of embodiments of the apparatus of FIG. 3; and FIG. 7 and FIG. 8 depict perspective views of embodiments of the apparatus of FIG. 3; and FIG. 9 and FIG. 10 depict perspective views of embodiments of the apparatus of FIG. 1; and FIG. 11 and FIG. 12 depict perspective views of embodiments of the apparatus of FIG. 1; and FIG. 13 and FIG. 14 depict side views of embodiments of the apparatus of FIG. 1; and FIG. 15 and FIG. 16 depict side views of embodiments of the apparatus of FIG. 1; and FIG. 17 and FIG. 18 depict side views of embodiments of the apparatus of FIG. 1; and FIG. 19 and FIG. 20 depict side views of embodiments of the apparatus of FIG. 1; and FIG. 21 and FIG. 22 depict side views of embodiments of the apparatus of FIG. 1; and FIG. 23 depicts a perspective view of an embodiment of the apparatus of FIG. 1; and FIG. 24 and FIG. 25 depict perspective views of embodiments of the apparatus of FIG. 1; and FIG. 26 and FIG. 27 depict perspective views of the embodiments of the apparatus of FIG. 1; and FIG. 28 and FIG. 29 depict perspective views of the embodiments of the apparatus of FIG. 1; and FIG. 30 depicts a perspective views of an embodiment of the apparatus of FIG. 1; and FIG. 31 and FIG. 32 depict side views of the embodiments of the apparatus of FIG. 1.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted. Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, and well-understood, elements that are useful in commercially feasible embodiments are often not depicted to provide a less obstructed view of the embodiments of the present disclosure.

LISTING OF REFERENCE NUMERALS USED IN THE DRAWINGS 100 apparatus
102 base assembly -continued 103 pivotal connection
104 first elongated member
105 edge portion
106 second elongated member
106 second elongated member
107 sacrificial portion
108 plate assembly
109 non-slip surface
110 angle
112 claw device
114 link structure
115 notch
116 pedestrian barricade
117 extension portion
118 access ramp
119 movement direction
121 direction
201 first alignment
202 second alignment
300 vehicular movement direction
302 rotation direction
302 rotation direction
302 rotation direction
500 fork-lift feature
600 lock device
601 flat plate portion
602 lock hole
603 stop portion
604 elongated stake
605 longitudinal stake axis
606 extending member
700 plate member
900 work surface
902 vehicle
903 wheel
904 pedestrian
906 bomb blast

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of the claim is defined by the claims (in which the claims may be amended during patent examination after the filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described. It will be appreciated that the scope of the meaning of a device configured to be coupled to an item (that is, to be connected to, to interact with the item, etc.) is to be interpreted as the device being configured to be coupled to the item, either directly or indirectly. Therefore, "configured to" may include the meaning "either directly or indirectly" unless specifically stated otherwise.

FIG. 1, FIG. 2, FIG. 3 and FIG. 4 depict side views of embodiments of an apparatus 100. The apparatus 100 may also be called a shield assembly or a vehicular barricade.

In accordance with a first major aspect, and with reference to the embodiments as depicted in FIG. 1, FIG. 2, FIG. 3 and FIG. 4, the apparatus 100 includes (and is not limited to) a synergistic combination of a base assembly 102, a first elongated member 104, a second elongated member 106, and a plate assembly 108.

In accordance with the first major aspect, and with reference to the embodiments as depicted in FIG. 1, FIG. 2, FIG. 3 and FIG. 4, the base assembly 102 (also called a frame) is positionable (is configured to be positionable) on a work surface 900. The work surface 900 may be called a horizontal working surface.

In accordance with the first major aspect, and with reference to the embodiments as depicted in FIG. 1, FIG. 2, FIG. 3 and FIG. 4, the first elongated member 104 is pivotally coupled (configured to be pivotally coupled) to the base assembly 102. The first elongated member 104 is pivotally movable (is configured to be pivotally movable).

In accordance with the first major aspect, and with reference to the embodiments as depicted in FIG. 1, FIG. 2, FIG. 3 and FIG. 4, the second elongated member 106 is affixed to, and extends from, the first elongated member 104.

The second elongated member 106 is configured to pivotally move and intimately contact a vehicle 902. The second elongated member 106 is also configured to hinder, at least in part, movement of the vehicle 902 (over and past the base assembly 102) in response to the vehicle 902 moving toward and striking and pivotally moving the first elongated member 104, with a weight of the vehicle 902 received, at least in part, by the base assembly 102.

In accordance with the first major aspect, and with reference to the embodiments as depicted in FIG. 1, FIG. 2, FIG. 3 and FIG. 4, the plate assembly 108 is affixed to, and extends from, the second elongated member 106. The plate assembly 108 is configured to support a pedestrian weight thereon. The plate assembly 108 shields, at least in part, a pedestrian 904 from a bomb blast 906 (a potential bomb blast) emanating from an underside of the vehicle 902 once the second elongated member 106 intimately contacts the vehicle 902. In accordance with a preferred embodiment, the plate assembly 108 includes a destructible metal component (that is, a metal component that may be torn at least in part, ripped at least in part, or able to be destroyed at least in part but not entirely) such as a sheet of aluminum plate and/or a steel checker plated sheet, etc., for light-arms protection (protection against firearms, hand guns, rifles, etc.). In accordance with another preferred embodiment, the plate assembly 108 includes a blast-proof metal alloy (a metal component that is not destructible), if so desired, for bomb-blast protection.

In accordance with the first major aspect, and with reference to the embodiments as depicted in FIG. 1, FIG. 2, FIG. 3 and FIG. 4, a technical advantage of the apparatus 100 (such as the plate assembly 108) provides a measure (a degree) of shielding (protection) against (from) the bomb blast 906 emanating from the vehicle 902 to the pedestrian 904 located nearby (close to the apparatus 100). A technical advantage is that the apparatus (the plate assembly) may provide a measure of shielding against the bomb blast emanating from the vehicle to the pedestrian located proximate to the plate assembly (once the bomb, which is mounted to vehicle, explodes).

In accordance with a second major aspect, and with reference to the embodiments as depicted in FIG. 1, FIG. 2, FIG. 3 and FIG. 4, the apparatus 100 includes (and is not limited to) a synergistic combination of a base assembly 102, a first elongated member 104, a second elongated member 106, and a plate assembly 108.

In accordance with the second major aspect, and with reference to the embodiments as depicted in FIG. 1, FIG. 2, FIG. 3 and FIG. 4, the base assembly 102 is positionable on a work surface 900.

In accordance with the second major aspect, and with reference to the embodiments as depicted in FIG. 1, FIG. 2, FIG. 3 and FIG. 4, the first elongated member 104 is pivotally coupled to (is configured to be pivotally coupled to) the base assembly 102. The first elongated member 104 is pivotally movable once the first elongated member 104 is pivotally coupled to the base assembly 102.

In accordance with the second major aspect, and with reference to the embodiments as depicted in FIG. 1, FIG. 2, FIG. 3 and FIG. 4, the second elongated member 106 is affixed to, and extends from, the first elongated member 104. It will be appreciated that the first elongated member 104 and the second elongated member 106 may include two elongated members that extend from a common joint connection, or the first elongated member 104 and the second elongated member 106 may include a single elongated member with a single elbow formed between the end portions of the single elongated member.

The second elongated member 106 is configured to pivotally move and intimately contact a vehicle 902. The second elongated member 106 is also configured to hinder, at least in part, movement of the vehicle 902 (over and past the base assembly 102) in response to the vehicle 902 moving toward and striking and pivotally moving the first elongated member 104 (with a weight of the vehicle 902 received, at least in part, by the base assembly 102). Movement of the first elongated member 104 urges the second elongated member 106 to pivotally move and intimately contact an underside of the vehicle 902 (which is moving); this is done in such a way that the second elongated member 106 hinders (halts), at least in part, movement of the vehicle 902 over and past the base assembly 102 (with the weight of the vehicle 902 received, at least in part, by the base assembly 102).

In accordance with the second major aspect, and with reference to the embodiments as depicted in FIG. 1, FIG. 2, FIG. 3 and FIG. 4, the plate assembly 108 is affixed to, and extends from, the second elongated member 106. The plate assembly 108 is configured to support pedestrian weight thereon once the plate assembly 108 is positioned coplanar relative to the work surface 900. The plate assembly 108 shields, at least in part, a pedestrian 904 (who is positioned proximate to the first elongated member 104) from a bomb blast 906 emanating from the underside of the vehicle 902 (once the second elongated member 106 is pivotally moved to intimately contact the vehicle 902).

In accordance with the second major aspect, and with reference to the embodiments as depicted in FIG. 1, FIG. 2, FIG. 3 and FIG. 4, a technical advantage of the apparatus 100 (such as the plate assembly 108) provides a measure (a degree) of shielding (protection) against (from) the bomb blast 906 emanating from the vehicle 902 to the pedestrian 904 located nearby (close to the apparatus 100). A technical advantage is that the apparatus (the plate assembly) may provide a measure of shielding against the bomb blast emanating from the vehicle to the pedestrian located proximate to the plate assembly (once the bomb, which is mounted to vehicle, explodes).

In accordance with a third major aspect, and with reference to the embodiments as depicted in FIG. 1, FIG. 2, FIG. 3 and FIG. 4, the apparatus 100 includes (and is not limited to) a synergistic combination of a base assembly 102, a first elongated member 104, a second elongated member 106, and a plate assembly 108.

In accordance with the third major aspect, and with reference to the embodiments as depicted in FIG. 1, FIG. 2, FIG. 3 and FIG. 4, the base assembly 102 is positionable on a work surface 900.

In accordance with the third major aspect, and with reference to the embodiments as depicted in FIG. 1, FIG. 2, FIG. 3 and FIG. 4, the first elongated member 104 is pivotally coupled to the base assembly 102. The first elongated member 104 is pivotally movable from a first alignment 201 toward a second alignment 202 once the first elongated member 104 is pivotally coupled to the base assembly 102. The first elongated member 104 is pivotally movable in response to a vehicle 902 (A) moving toward and striking the first elongated member 104 positioned in the first alignment 201, and (B) urging pivotal movement of the first elongated member 104 toward the second alignment 202.

In accordance with the third major aspect, and with reference to the embodiments as depicted in FIG. 1, FIG. 2, FIG. 3 and FIG. 4, the second elongated member 106 is affixed to, and extends from, the first elongated member 104. The second elongated member 106 and the first elongated member 104 define an angle 110 subtended therebetween. The second elongated member 106 is configured to pivotally move and intimately contact the vehicle 902. The second elongated member 106 is also configured to hinder, at least in part, movement of the vehicle 902 (over and past the base assembly 102) in response to the vehicle 902 moving toward and striking and pivotally moving the first elongated member 104 from the first alignment 201 toward the second alignment 202. Movement of the first elongated member 104 (from the first alignment 201 toward the second alignment 202) urges the second elongated member 106 to pivotally move and intimately contact an underside of the vehicle 902 (which is moving); this is done in such a way that the second elongated member 106 hinders (halts), at least in part, movement of the vehicle 902 over and past the base assembly 102 (with a weight of the vehicle 902 received, at least in part, by the base assembly 102 once the vehicle 902 is halted by the second elongated member 106).

In accordance with the third major aspect, and with reference to the embodiments as depicted in FIG. 1, FIG. 2, FIG. 3 and FIG. 4, the plate assembly 108 is affixed to, and extends from, a lateral elongated side of the second elongated member 106. The plate assembly 108 is configured to support a pedestrian weight thereon once the plate assembly 108 is positioned coplanar relative to the work surface 900. The plate assembly 108 is configured to shield, at least in part, a pedestrian 904 (who is positioned proximate to the first elongated member 104) from a bomb blast 906 emanating from the underside of the vehicle 902 (once the second elongated member 106 intimately contacts the underside of the vehicle 902).

In accordance with the third major aspect, and with reference to the embodiments as depicted in FIG. 1, FIG. 2, FIG. 3 and FIG. 4, a technical advantage of the apparatus 100 (such as, the plate assembly 108) provides a measure (a degree) of shielding (protection) against (from) the bomb blast 906 emanating from the vehicle 902 to the pedestrian 904 located nearby (to the apparatus 100). A technical advantage is that the apparatus (the plate assembly) may provide a measure of shielding against the bomb blast emanating from the vehicle to the pedestrian located proximate to the plate assembly (once the bomb, which is mounted to vehicle, explodes).

Referring to the embodiment as depicted in FIG. 1, the vehicle 902 (preferably) moves along the vehicular movement direction 300 toward the first elongated member 104. The vehicle 902 moves, at least in part, over the base assembly 102 and toward the first elongated member 104. Eventually, the vehicle 902 comes to a full stop (as depicted in FIG. 4).

Referring to the embodiments as depicted in FIG. 2 and FIG. 3, the apparatus 100 (preferably) further includes a claw device 112. The claw device 112 extends from the first elongated member 104. The claw device 112 is configured to dig into the work surface 900 in response to the vehicle 902 striking and pivotally moving the first elongated member 104 (toward the second alignment 202 as depicted in FIG. 4). As the first elongated member 104 is pivotally rotated, the claw device 112 is made to dig (configured to dig in) into the surface of the work surface 900. Preferably, the claw device 112 includes a sharp point. The vehicle 902 continues to move along the vehicular movement direction 300, and the vehicle 902 (eventually) strikes the first elongated member 104. In response to being stricken, the first elongated member 104 (preferably) is pivotally moved along the rotation direction 302 (away from the first alignment 201, as depicted in FIG. 1). The movement of the first elongated member 104, in response, urges pivotal movement of the second elongated member 106 along the rotation direction 302A (toward the first alignment 201, as depicted in FIG. 1). Preferably, the movement of the first elongated member 104 urges pivotal movement of the claw device 112 along the rotation direction 302B (toward the work surface 900).

Referring to the embodiments as depicted in FIG. 3 and FIG. 4, the vehicle 902 continues to move along the vehicular movement direction 300. As the vehicle 902 movers further over the base assembly 102, the wheel 903 of the vehicle 902 striking the bottom side of the plate assembly 108, and the wheel 903 inflicts physical damage to the plate assembly 108 by shearing or tearing into the plate assembly 108, and causing the formation of a sacrificial portion 107. The plate assembly 108 (preferably) includes the sacrificial portion 107 configured to be torn from the plate assembly 108 in response to the wheel 903 of the vehicle 902 strikes the plate assembly 108.

Referring to the embodiment as depicted in FIG. 4, the sacrificial portion 107 (preferably) becomes larger once the vehicle 902 stops movement and rests over the base assembly 102.

Referring to the embodiments as depicted in FIG. 3 and FIG. 4, the plate assembly 108 (preferably) extends from, and beyond, opposite lateral sides of the first elongated member 104.

Referring to the embodiments as depicted in FIG. 1, FIG. 2, FIG. 3 and FIG. 4, the angle 110 (preferably) is about 90 degrees. It will be appreciated that there are a range of values for the angle 110 that may be utilized while achieving the same functional and/or structural result as 90 degrees.

Referring to the embodiments as depicted in FIG. 1, FIG. 2, FIG. 3 and FIG. 4, the second elongated member 106 (preferably) is positioned under, and is affixed to, the plate assembly 108 (for instance, by welding means, etc.). The second elongated member 106 supports the plate assembly 108 (along with the weight (pedestrian weight) of pedestrians standing and/or walking on the plate assembly 108).

Referring to the embodiments as depicted in FIG. 1, FIG. 2, FIG. 3 and FIG. 4, the apparatus 100 (preferably) further includes a pivotal connection 103 affixed to an edge section (edge portion) of the base assembly 102. The first elongated member 104 is pivotally coupled (connected) to the pivotal connection 103. The pivotal connection 103 may include a pin, a fulcrum, and any equivalent thereof.

Referring to the embodiment as depicted in FIG. 4, in the second alignment 201, the plate assembly 108 and the base assembly 102 are pivotally separated from each other.

Referring to the embodiment as depicted in FIG. 1, in the first alignment 202, the plate assembly 108 and the base assembly 102 are (preferably) coplanar with each other.

Referring to the embodiment as depicted in FIG. 1, the first alignment 201 (preferably) includes a vertical alignment (relative to the work surface 900).

Referring to the embodiments as depicted in FIG. 4, the second alignment 202 (preferably) includes a horizontal alignment (relative to the work surface 900).

FIG. 5 and FIG. 6 depict perspective views of embodiments of the apparatus 100 of FIG. 3.

Referring to the embodiments as depicted in FIG. 5 and FIG. 6, the vehicle 902 (preferably) rests on the base assembly 102. The base assembly 102 may be configured to fully support the weight of the vehicle 902 (without the base assembly 102 crumpling). The end sections of the second elongated members (106A, 106B, 106C) intimately make contact with at least one or more components of the vehicle 902 (such as with the wheel axle, etc.). The plate assembly 108 is removed to improve the view of the manner of contact between the second elongated members (106A, 106B, 106C) and the vehicle 902. The vehicle 902 is depicted a the frame and wheels of a typical north American model 5 tonne truck commonly used in the rental market. The second elongated members (106A, 106B, 106C) are spaced apart from each other. The first elongated members (104A, 106B, 104C) are spaced apart from each other. The claw devices (112A, 112B, 112C) are spaced apart from each other.

FIG. 7 and FIG. 8 depict perspective views of embodiments of the apparatus 100 of FIG. 3.

Referring to the embodiments as depicted in FIG. 7 and FIG. 8, the plate assembly 108 (preferably) is partially crumpled or destroyed by the wheels of the vehicle 902.

FIG. 9 and FIG. 10 depict perspective views of embodiments of the apparatus 100 of FIG. 1. FIG. 11 and FIG. 12 depict perspective views of embodiments of the apparatus 100 of FIG. 1, and FIG. 13 and FIG. 14 depict side views of embodiments of the apparatus 100 of FIG. 1.

Referring to the embodiment as depicted in FIG. 9, the first elongated members (104A, 104B, 104C) are pivotally moved along the rotation direction 302. The second elongated members (106A, 106B, 106C) are pivotally moved along the rotation direction 302A. Preferably, the first elongated members (104A, 104B, 104C) are moved in unison, and the second elongated members (106A, 106B, 106C) are moved in unison.

Referring to the embodiment as depicted in FIG. 9, the apparatus 100 is positioned in a normal condition (or state), in which the plate assembly 108 and the second elongated member 106 are aligned horizontally so that a pedestrian may walk or stand thereon. In accordance with an embodiment, the base assembly 102 further includes spaced-apart fork-lift features (500A, 500B), which may be called fork lift pockets, etc. The spaced-apart fork-lift features (500A, 500B) are configured to receive the extended forks of a fork-lift vehicle (known and not depicted). In this manner, the base assembly 102 may be transported to a desired location, etc.

Referring to the embodiment as depicted in FIG. 10, the apparatus 100 is positioned in an activated condition (or state), in which the second elongated member 106 is aligned at an acute angle relative to the working surface (so that the second elongated member 106 may be deployed for hindering the motion of a vehicle).

Referring to the embodiments as depicted in FIG. 9 and FIG. 10, the base assembly 102 is configured to accommodate a plurality of first elongated members (104A, 104B, 104C) all of which are connected to the plate assembly 108. The plurality of first elongated members (104A, 104B, 104C) are pivotally movable together in unison relative to the base assembly 102. The base assembly 102 is configured to pivotally connect with the plurality of first elongated members (104A, 104B, 104C). The plurality of first elongated members (104A, 104B, 104C) may be utilized for the movement of the plate assembly 108 (a single plate assembly or one and only one plate assembly).

Referring to the embodiments as depicted in FIG. 9, FIG. 10, FIG. 11, FIG. 12, FIG. 13 and FIG. 14, a hand rail or a pedestrian barricade (preferably) is not included with these embodiments. The plate assembly 108 is removed from FIG. 12 to improve the view of the internal structure of the base assembly 102. For instance, the base assembly 102 may include cross-bracing members extending between a peripheral frame formation.

Referring to the embodiments as depicted in FIG. 9 and FIG. 10, the plate assembly 108 (preferably) has a lateral span (a side-to-side span or width). The lateral span of the plate assembly 108 is wider than the lateral span of the first elongated member 104. The plate assembly 108 (preferably) extends between the opposite lateral sides of the base assembly 102. The plate assembly 108 (preferably) extends between, and covers, the opposite lateral sides of the base assembly 102.

Referring to the embodiments as depicted in FIG. 9 and FIG. 10, the plate assembly 108 (preferably) extends laterally past the opposite elongated lateral edges (side edges) of the second elongated member 106. The plate assembly 108 (preferably) extends between the opposite lateral sides of the base assembly 102. The plate assembly 108 (preferably) extends between, and covers, the opposite lateral sides of the base assembly 102.

Referring to the embodiments as depicted in FIG. 9 and FIG. 10, the plate assembly 108 (preferably) includes a non-slip surface 109. The non-slip surface 109 is configured to improve the walking safety of a pedestrian along thereon. The non-slip surface 109 may include a textured surface (a relief feature) formed thereon, etc.). The non-slip surface 109 may extend vertically upwardly (once the plate assembly 108 is placed in a horizontal orientation). The non-slip surface 109 may include a layer of rubberized material adhered to the top surface of the plate assembly 108.

Referring to the embodiments as depicted in FIG. 9 and FIG. 10, the plate assembly 108 (preferably) has (includes) a top surface. The top surface is configured to support a pedestrian weight thereon (preferably, once the plate assembly 108 is positioned to face over the base assembly 102, or once the plate assembly 108 is positioned in the second alignment 202). The plate assembly 108 has a bottom surface (bottom portion) that faces the work surface 900 once the plate assembly 108 is positioned over the base assembly 102, or once the plate assembly 108 is positioned in the second alignment 202.

Referring to the embodiments as depicted in FIG. 9 and FIG. 10, the plate assembly 108 (preferably) includes a sheet of aluminum (for light weight advantage).

Referring to the embodiment as depicted in FIG. 13, the first elongated member 104 is pivotally moved along the rotation direction 302. The second elongated member 106 is pivotally moved along the rotation direction 302A. The claw device 112 is pivotally moved along the rotation direction 302B.

FIG. 15 and FIG. 16 depict side views of embodiments of the apparatus 100 of FIG. 1. FIG. 17 and FIG. 18 depict side views of embodiments of the apparatus 100 of FIG. 1. FIG. 19 and FIG. 20 depict side views of embodiments of the apparatus 100 of FIG. 1.

Referring to the embodiments as depicted in FIG. 15 and FIG. 16, the apparatus 100 (preferably) further includes a pedestrian barricade 116. The pedestrian barricade 116 may include a plurality of vertically-extending posts arranged or positioned one after the other along a row, with a horizontally-extending hand rail (also called a hand rail) connected to the distal end portions of the plurality of vertically-extending posts. The pedestrian barricade 116 is configured to be affixed to, and extend upwardly from, a top surface of the plate assembly 108 (for instance, once the plate assembly 108 is positioned in the second alignment 202). The pedestrian barricade 116 is utilized for crowd control and/or pedestrian corralling, etc. In accordance with an embodiment (as depicted in FIG. 15), the pedestrian barricade 116 is configured to be mounted on one side (an elongated side) of the base assembly 102. The pedestrian barricade 116 is spaced apart from the first elongated member 104 once the first elongated member 104 is placed in the first alignment 201. The pedestrian barricade 116 and the first elongated member 104 forms a pedestrian access corridor (in accordance with an option). The pedestrian barricade 116 and the first elongated member 104 forms a buffer zone (in accordance with another option) for security personnel to move back and forth relatively unimpeded. Depicted are the pivotal connections (103A, 103B, 103C), etc.

FIG. 21 and FIG. 22 depict side views of embodiments of the apparatus 100 of FIG. 1.

Referring to the embodiments as depicted in FIG. 21, the apparatus 100 (preferably) further includes a link structure 114. The link structure 114 is positioned along an edge portion 105A of the base assembly 102. The link structure 114 is configured to facilitate linkage with (selective connection with) a corresponding link structure 114A of an adjacently-positioned base assembly 102A. The link structure) 14A is configured to facilitate a selective linked connection with a corresponding link structure of an adjacently-positioned base assembly.

Referring to the embodiments as depicted in FIG. 22, the opposite edge portions (105A, 105B) of the base assembly 102 (preferably) each include corresponding link structures 114 (as depicted in FIG. 22) which are configured to facilitate an end-to-end abutment connection between end-to-end positioned base assemblies (102, 102B) (as depicted in FIG. 23). Once the corresponding link structures (114, 114A) are connected together, the end-to-end positioned base assemblies (102, 102B) become coupled to each other. The corresponding link structures (114, 114A) are configured to connect together (with each other) in such a way that the end-to-end positioned base assemblies (102, 102B) may be coupled to each other.

FIG. 23 depicts a perspective view of an embodiment of the apparatus 100 of FIG. 1.

Referring to the embodiment as depicted in FIG. 23, the base assembly 102 (preferably) is configured to accommodate (A) a first elongated member 104A (which is affixed or coupled (via the pivotal connection 103A) to a plate assembly 108A), (B) a second elongated member 104B (which is affixed or coupled, via a pivotal connection (not depicted), to a plate assembly 108B), and (C) a third elongated member 104C (which is affixed or coupled, via a pivotal connection (not depicted), to a plate assembly 108C). A plurality of the first elongated members (104A, 104B, 104C) are independently pivotally movable relative to each other. The plurality of the first elongated members (104A, 104B, 104C) is pivotally connected to (an edge portion of) the base assembly 102. The base assembly 102 is configured to pivotally connect with the plurality of first elongated members (104A, 104B, 104C) all of which are affixed to respective plate assemblies (108A, 108B, 108C).

FIG. 24 and FIG. 25 depict perspective views of embodiments of the apparatus 100 of FIG. 1.

Referring to the embodiments as depicted in FIG. 24, the apparatus 100 (preferably) further includes an access ramp 118 (for pedestrians). The access ramp 118 has a width, a length and a variable height. The access ramp 118 is configured to be placed in an abutment relationship to the edge portion of the base assembly 102. Preferably, the access ramp 118 is configured to be connectable to (coupled to) an edge portion of the base assembly 102. The access ramp 118 has a wedge-shaped profile. The access ramp 118 provides a transition extending from the work surface 900 to the top surface of the plate assembly 108 of the base assembly 102 (once the access ramp 118 is placed on the work surface 900, and the access ramp 118 is in abutment with the base assembly 102, and the plate assembly 108 is placed proximate to the base assembly 102). For instance, the access ramp 118 includes structural ribs positioned underside of the access ramp 118 (as depicted in FIG. 25).

Referring to the embodiment as depicted in FIG. 25, the access ramp 118 (preferably) is rotated along the rotation direction 302 (or simply lifted away from the base assembly 102). The link structure 114 is positioned at an edge portion of the access ramp 118. The link structure 114 of the access ramp 118 is connectable to the link structure 114 of the base assembly 102. This is done in such a way that the access ramp 118 remains stationary relative to the base assembly 102.

FIG. 26 is, specifically, a close-up perspective view of the embodiment as depicted in FIG. 9. Referring to the embodiment as depicted in and FIG. 27, the first base assembly 102A and the second base assembly 102B are positioned proximate to each other in an end-to-end relationship (also called an abutment relationship).

Figure 26:
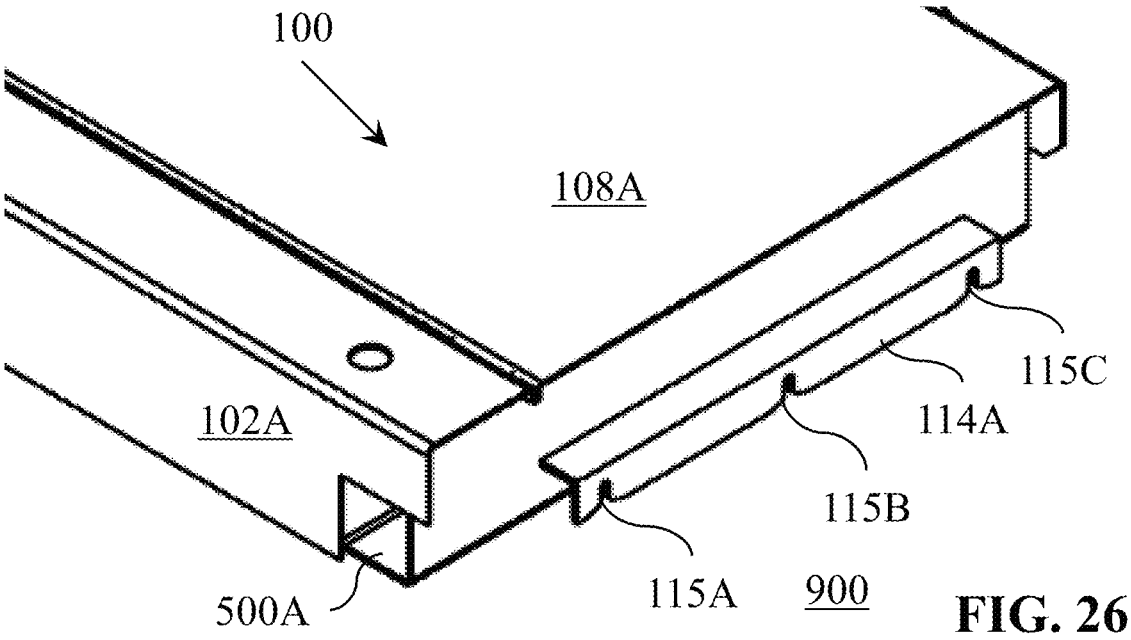
FIG. 26 and FIG. 27 depict perspective views of the embodiments of the apparatus 100 of FIG. 1.
Figure 27:
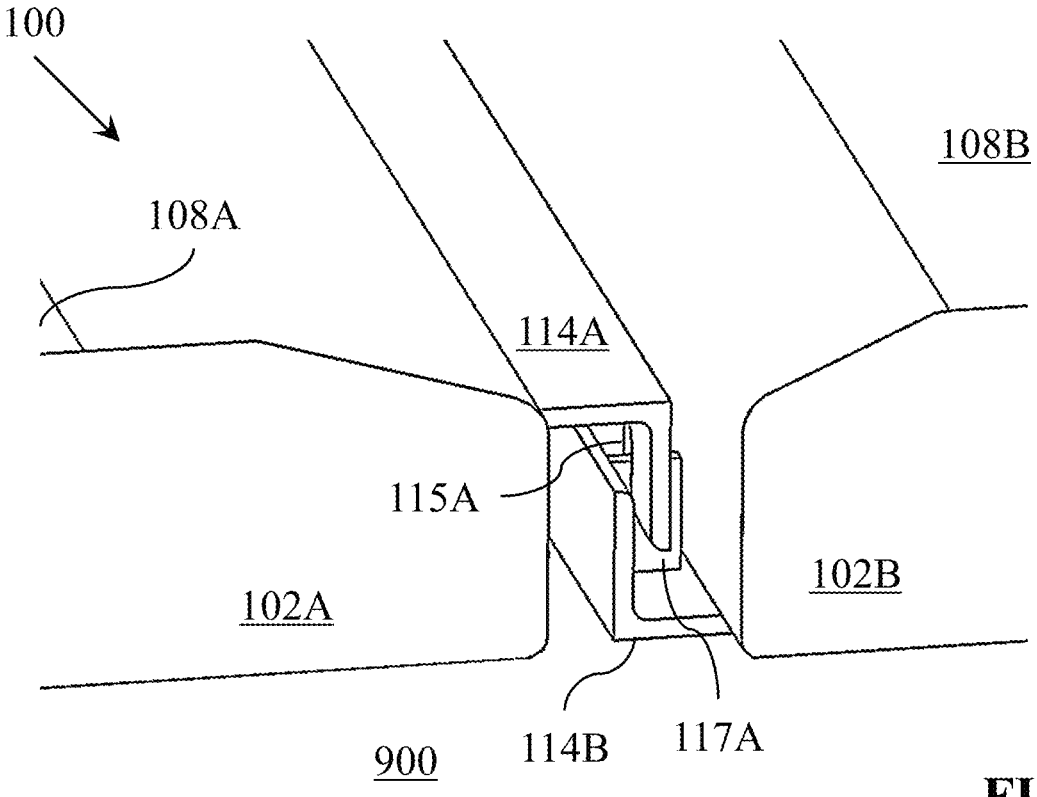

Referring to the embodiments as depicted in FIG. 26 and FIG. 27, the first link structure 114A (of the first base assembly 102A) is configured to be mounted to (affixed to), and extend from, an end section (end portion) of the first base assembly 102A. The first link structure 114A includes (preferably) an angled elongated L-shaped bracket that is welded to the end section of the first base assembly 102A. The first link structure 114A includes (provides) spaced-apart notches (115A, 115B, 115C) located or positioned along a longitudinal length of the first link structure 114A.

Referring to the embodiments as depicted in FIG. 26 and FIG. 27, the second link structure 114B (of the second base assembly 102B) is configured to be mounted to (affixed to), and extend from, an end section (an end portion) of the second base assembly 102B. The second link structure 114B includes (preferably) an angled elongated L-shaped bracket that is welded to the end section of the second base assembly 102B. The second link structure 114B includes (provides) spaced-apart extension portions (117A, 117B, 117C) located (or positioned) along a longitudinal length of the second link structure 114B (this arrangement is better viewed from the embodiment of FIG. 28). The spaced-apart extension portions (117A, 117B, 117C) and the spaced-apart notches (115A, 115B, 115C) are configured to be mated (selectively mated or selectively linked) with each other (that is, to be received, at least in part, one within the other). The spaced-apart extension portions (117A, 117B, 117C) and the spaced-apart notches (115A, 115B, 115C) are configured to prevent the first base assembly 102A and the second base assembly 102B from moving relative to each other (once the spaced-apart extension portions (117A, 117B, 117C) and the spaced-apart notches (115A, 115B, 115C) are mated, at least in part, with each other). Generally, the first link structure 114A and the second link structure 114B are configured to prevent the first base assembly 102A and the second base assembly 102B from moving laterally side to side (once mated accordingly with each other).

Figure 1:
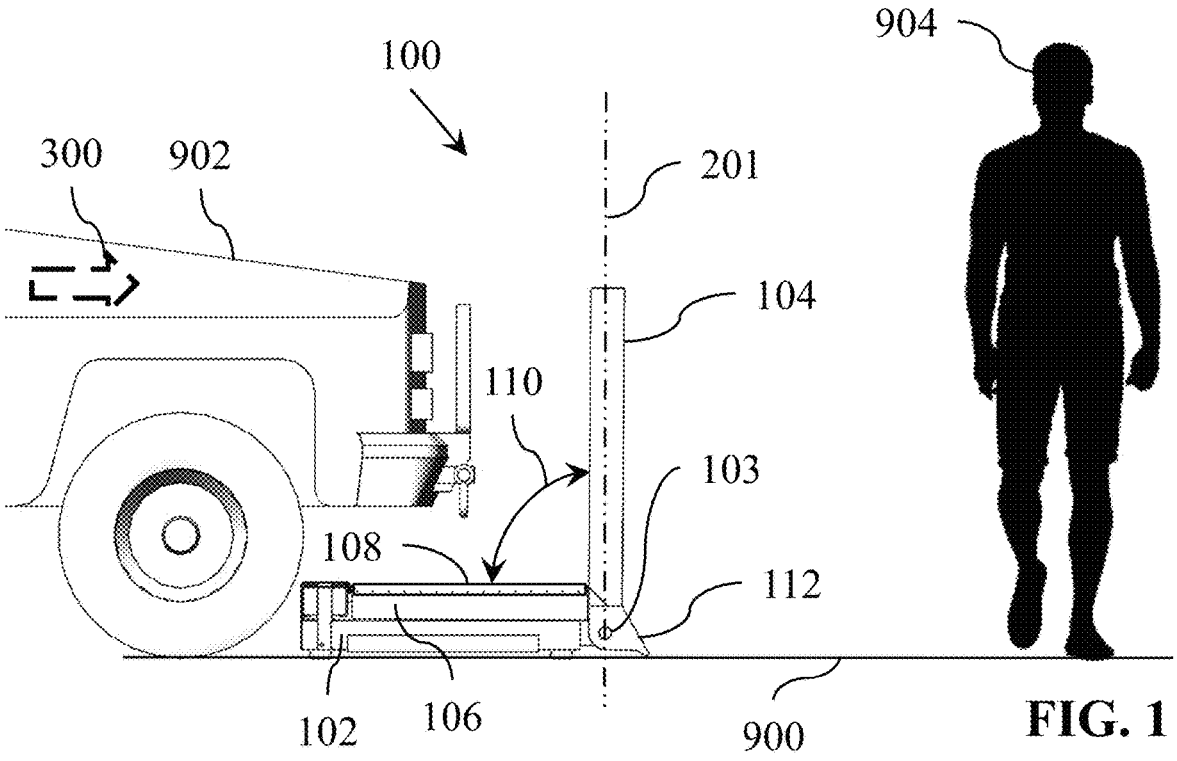
Figure 2:
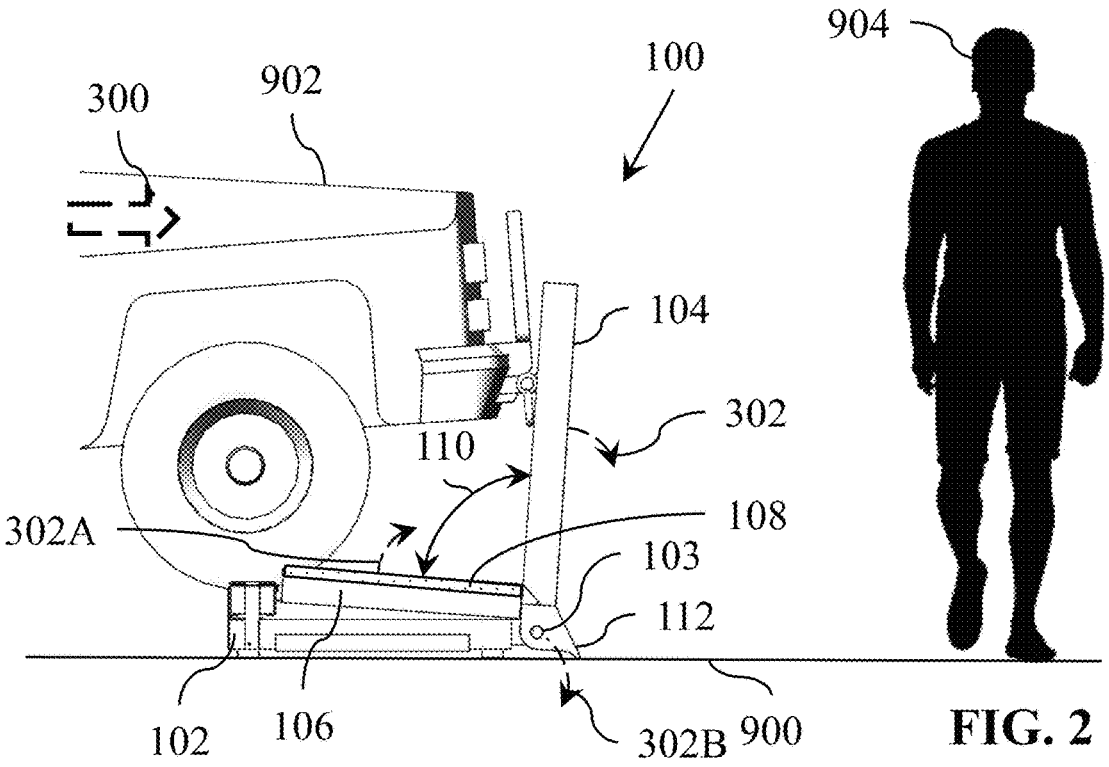
Figure 3:
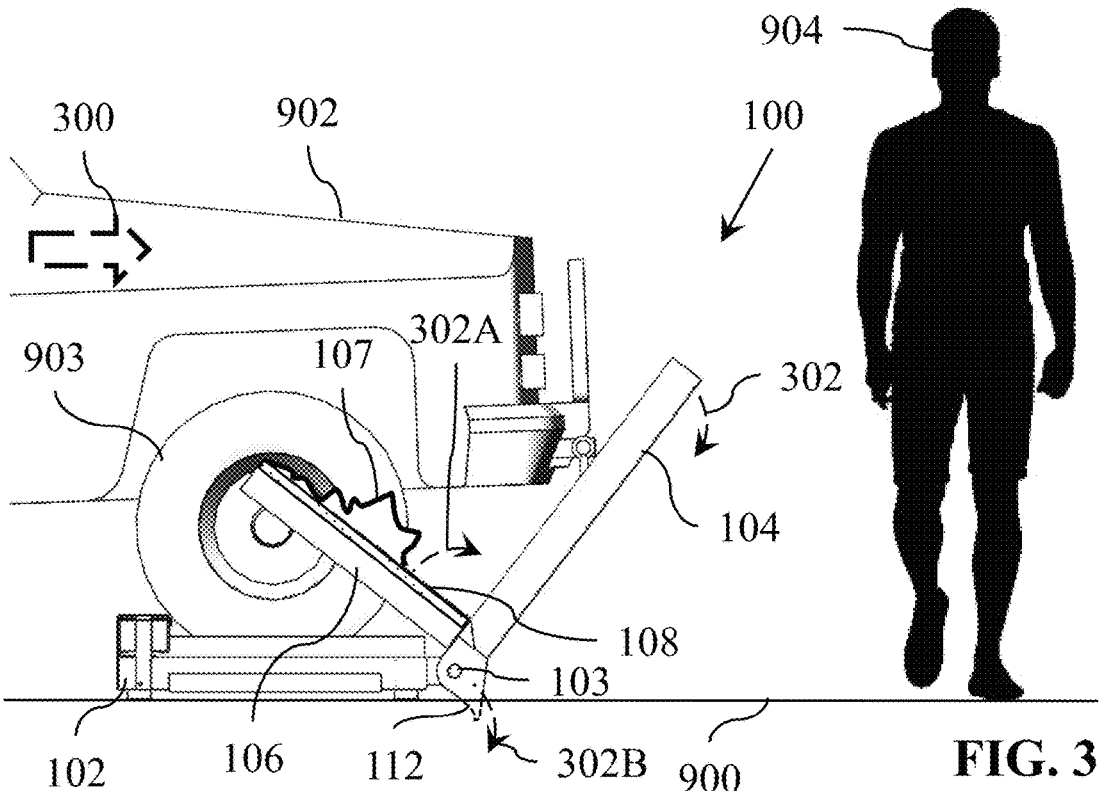
Figure 4:
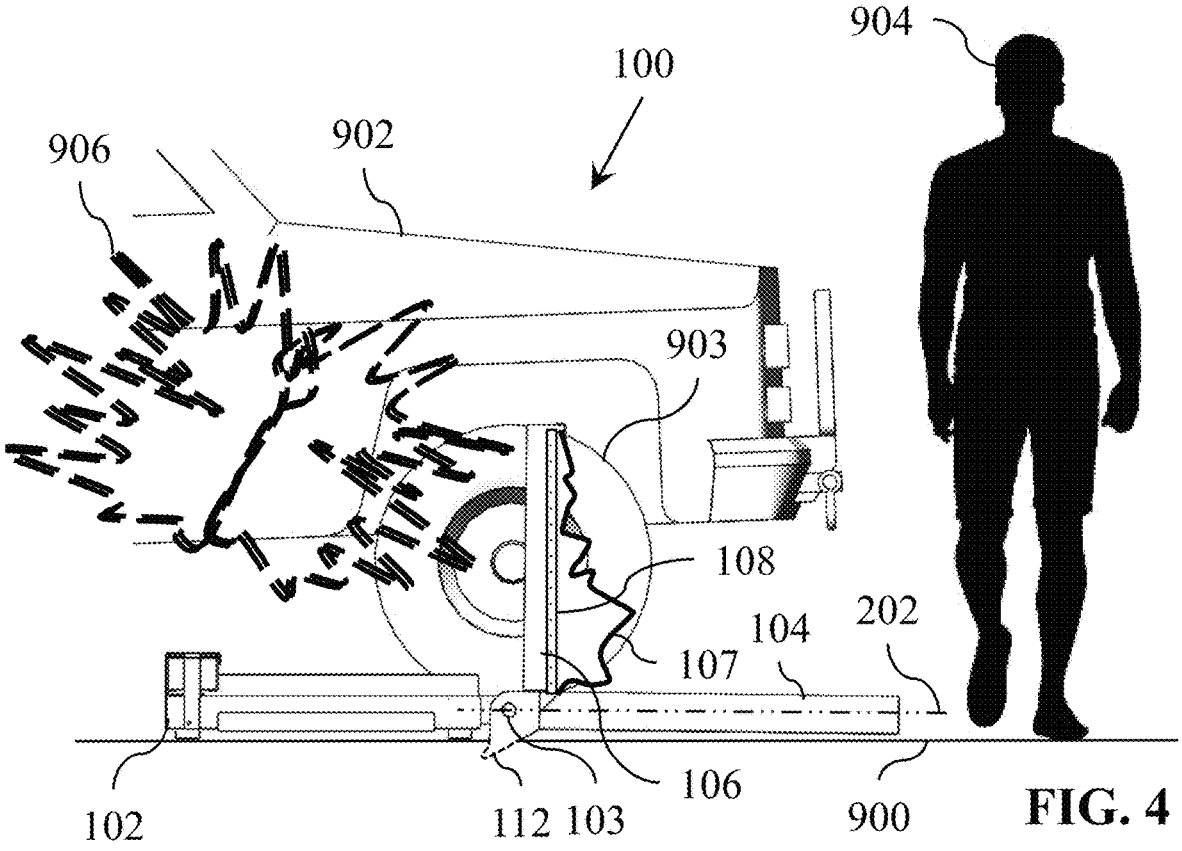
Figure 5:
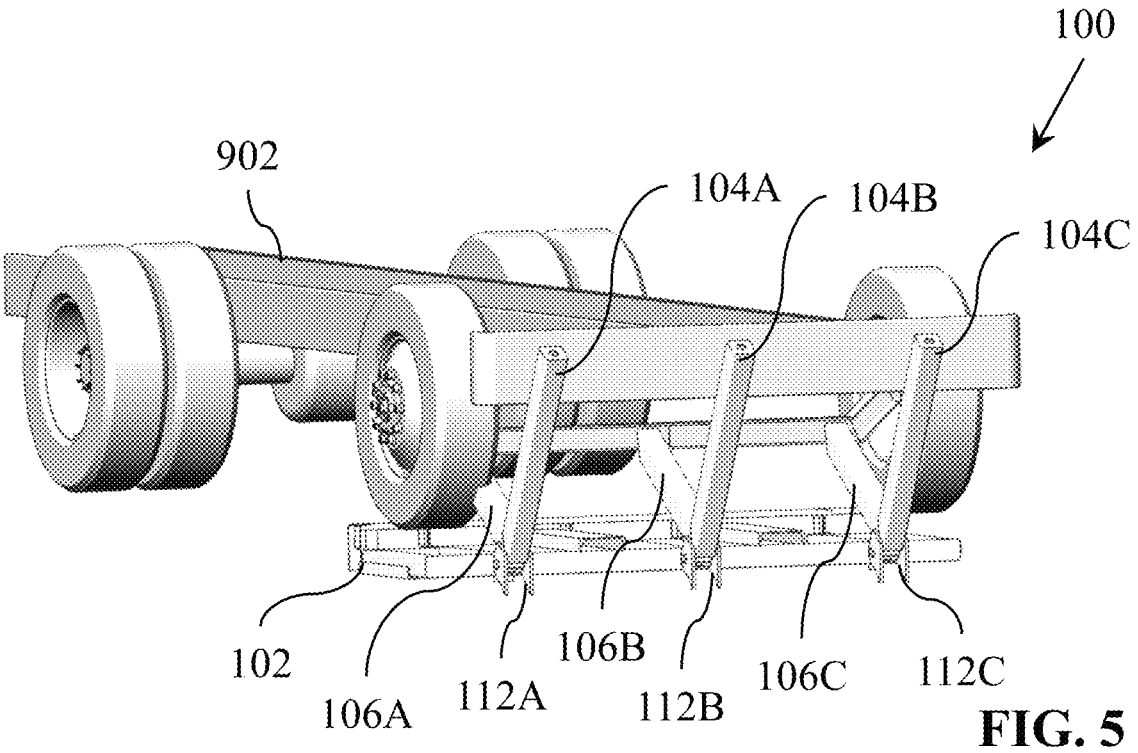
Figure 6:
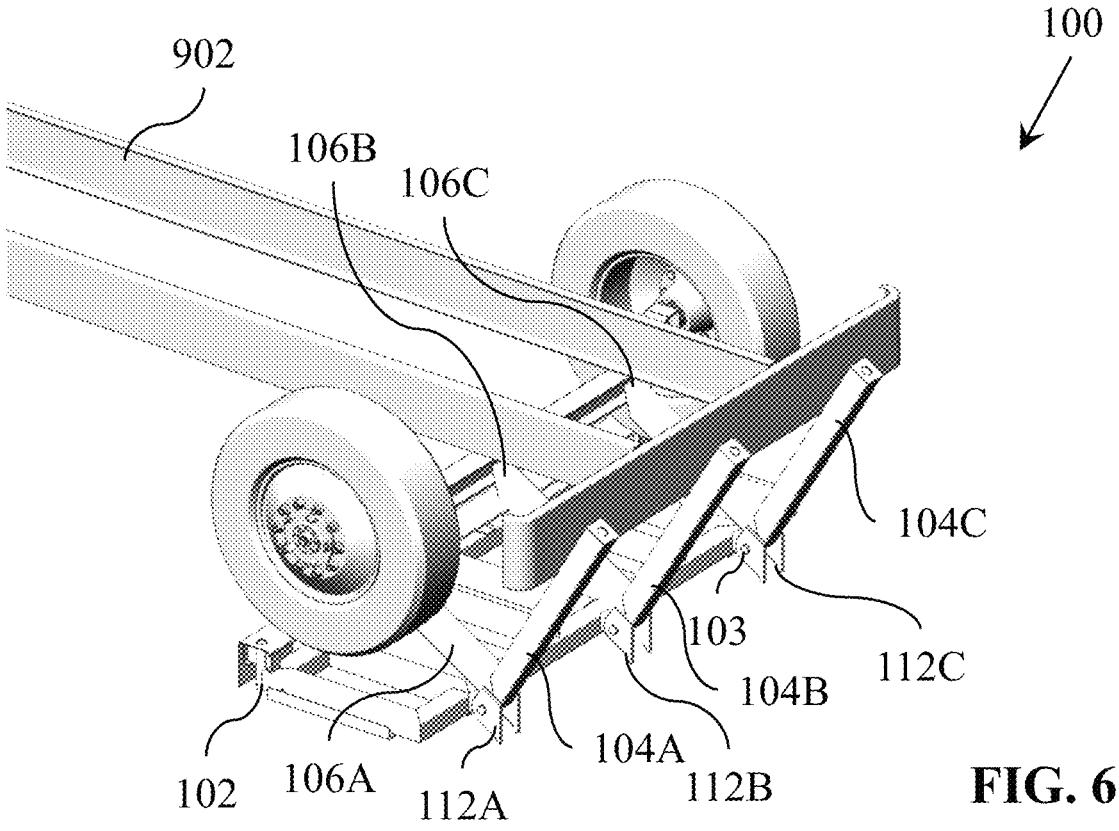
Figure 7:
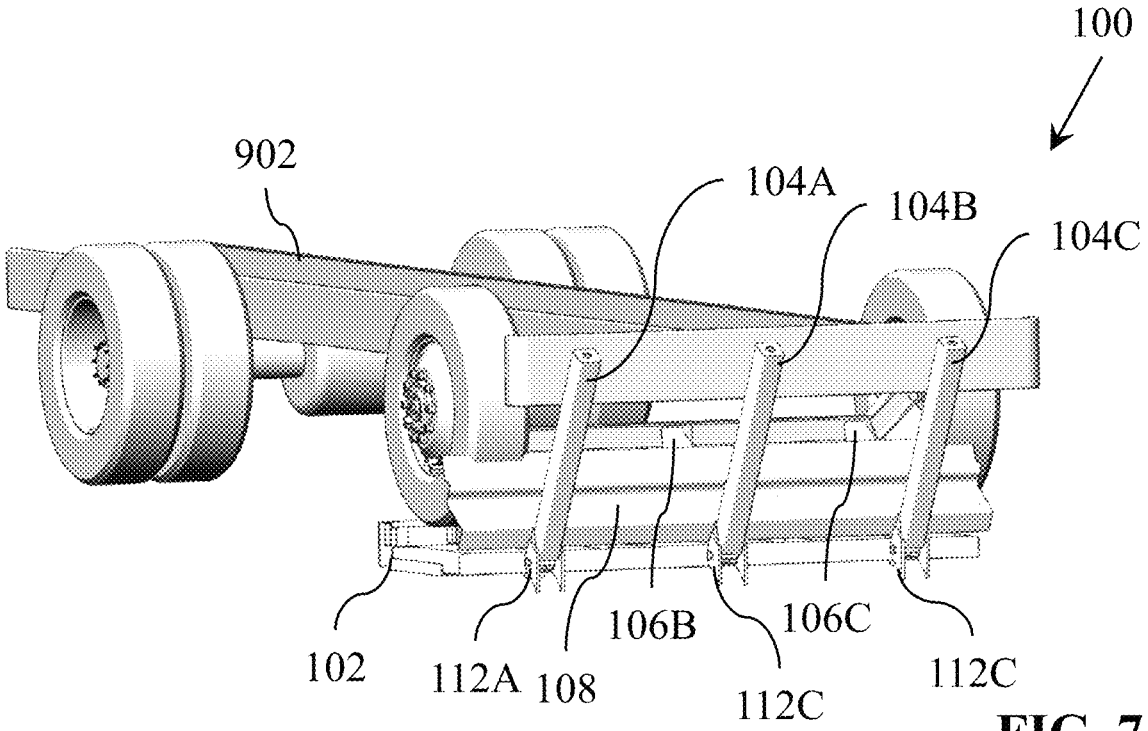
Figure 8:
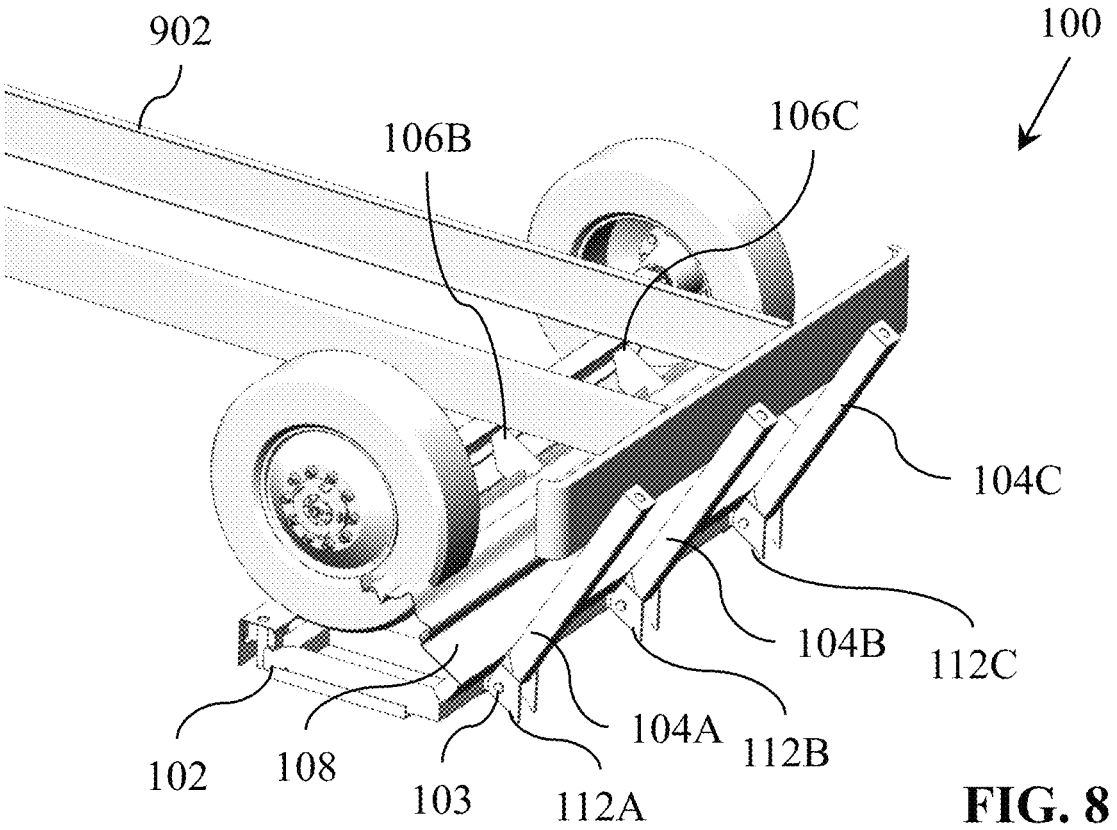
Figure 9:
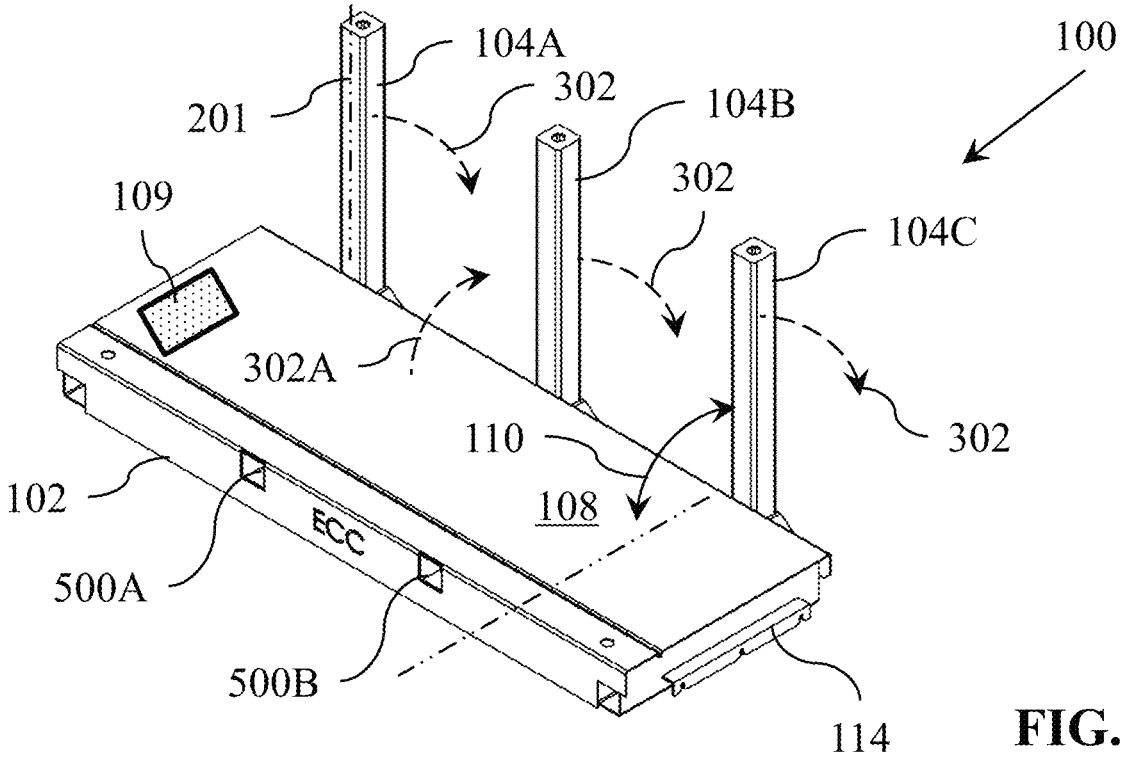
Figure 10:
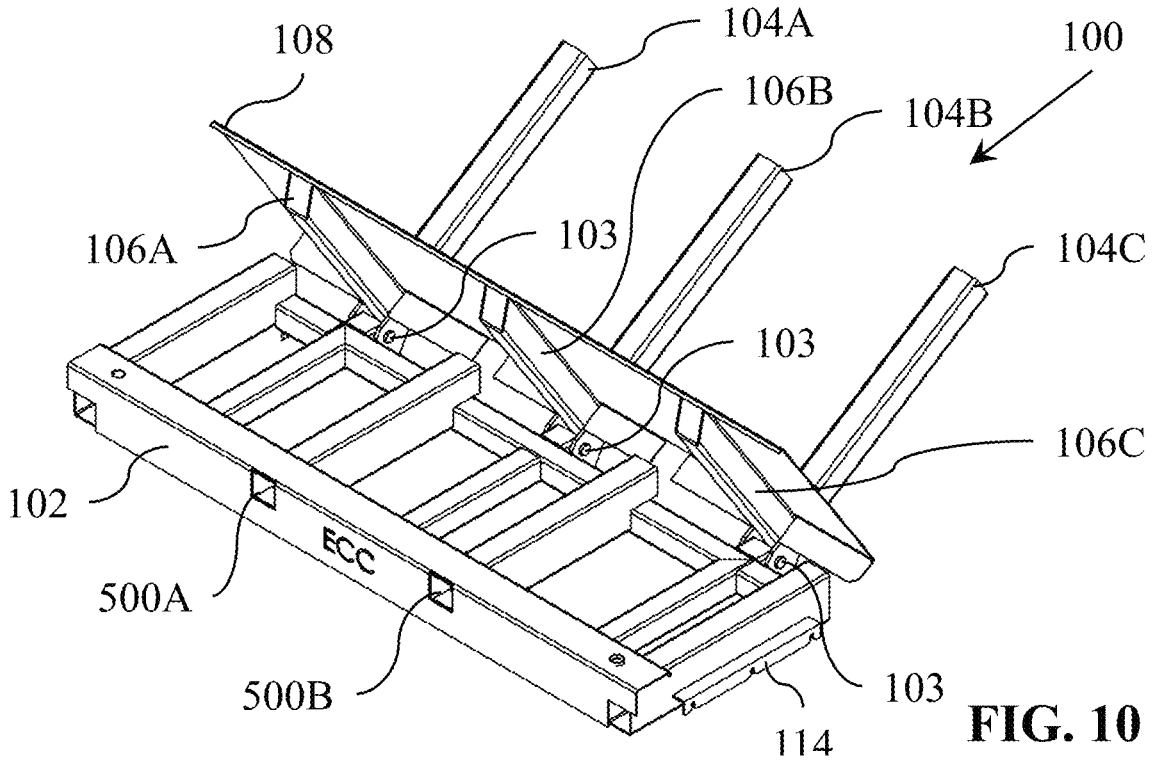
Figure 11:
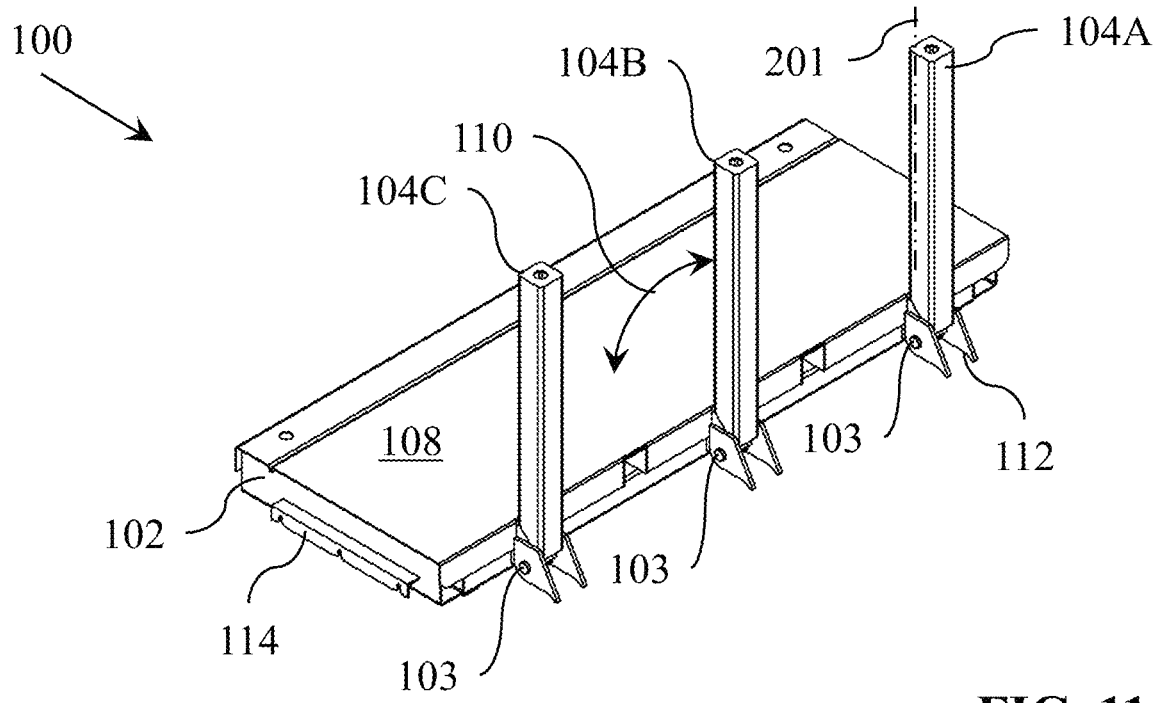
Figure 12:
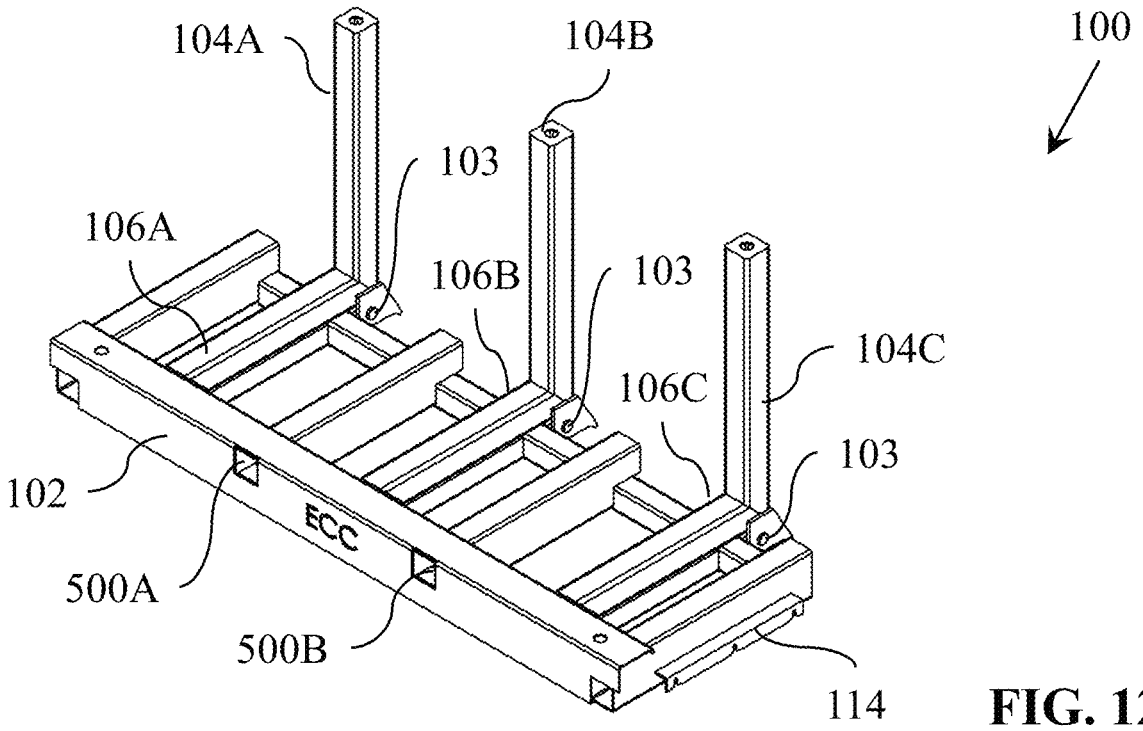
Figure 13:
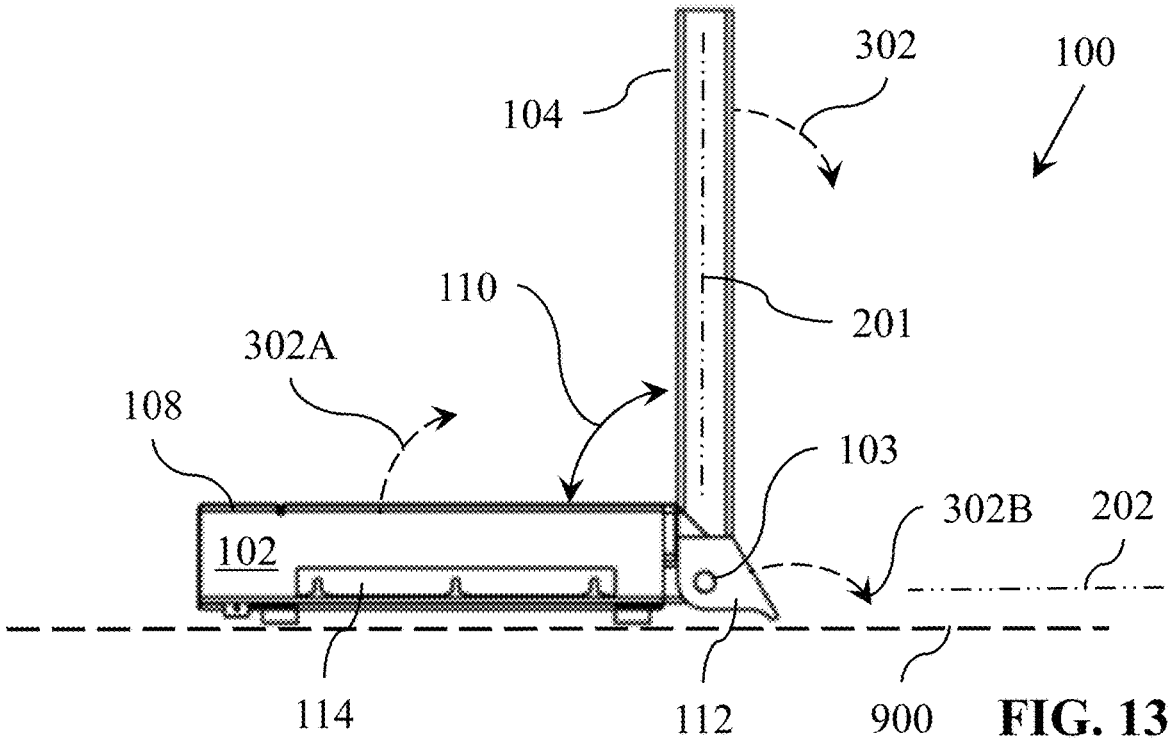
Figure 14:
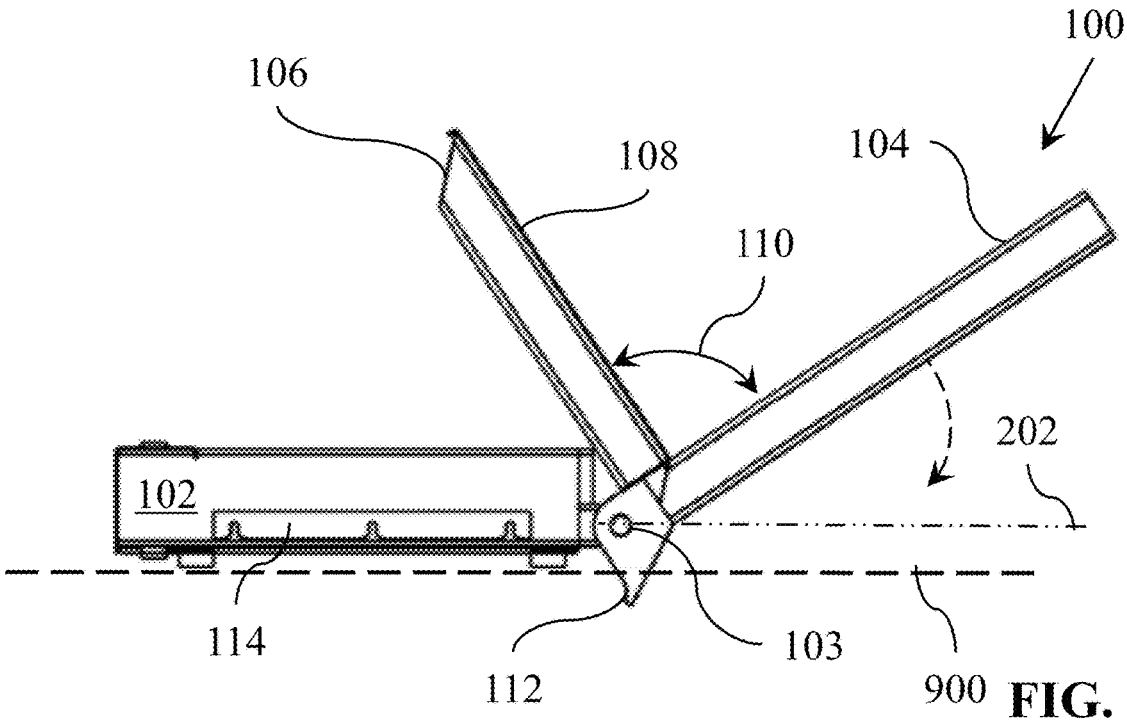
Figure 15:
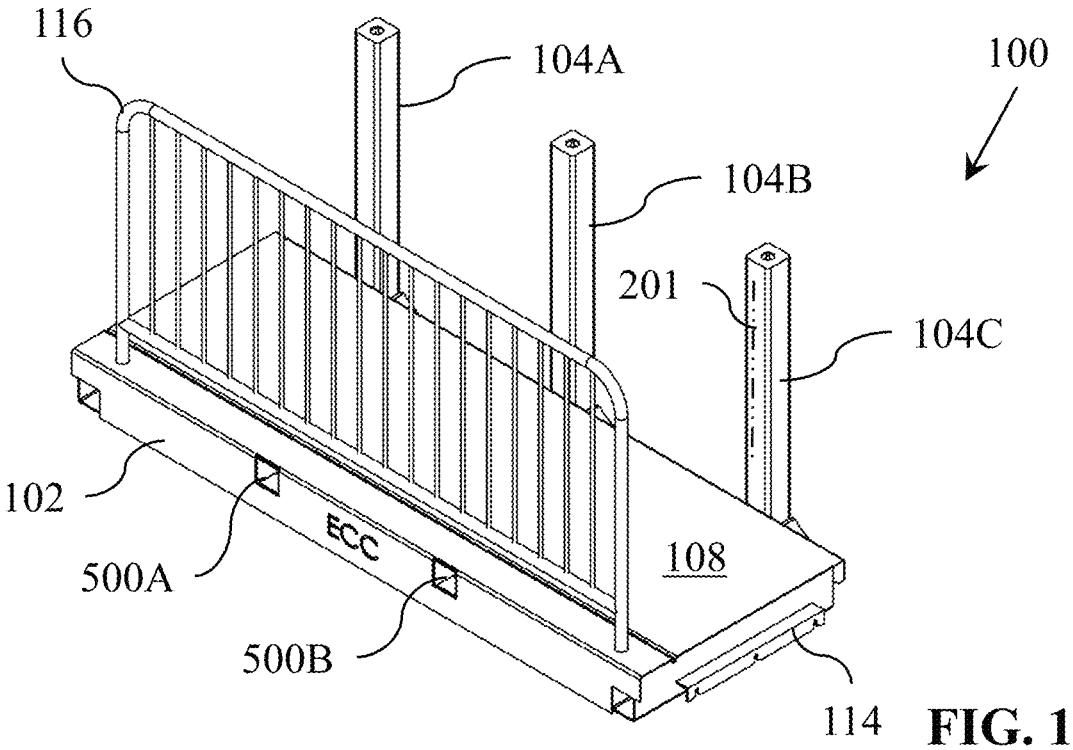
Figure 16:
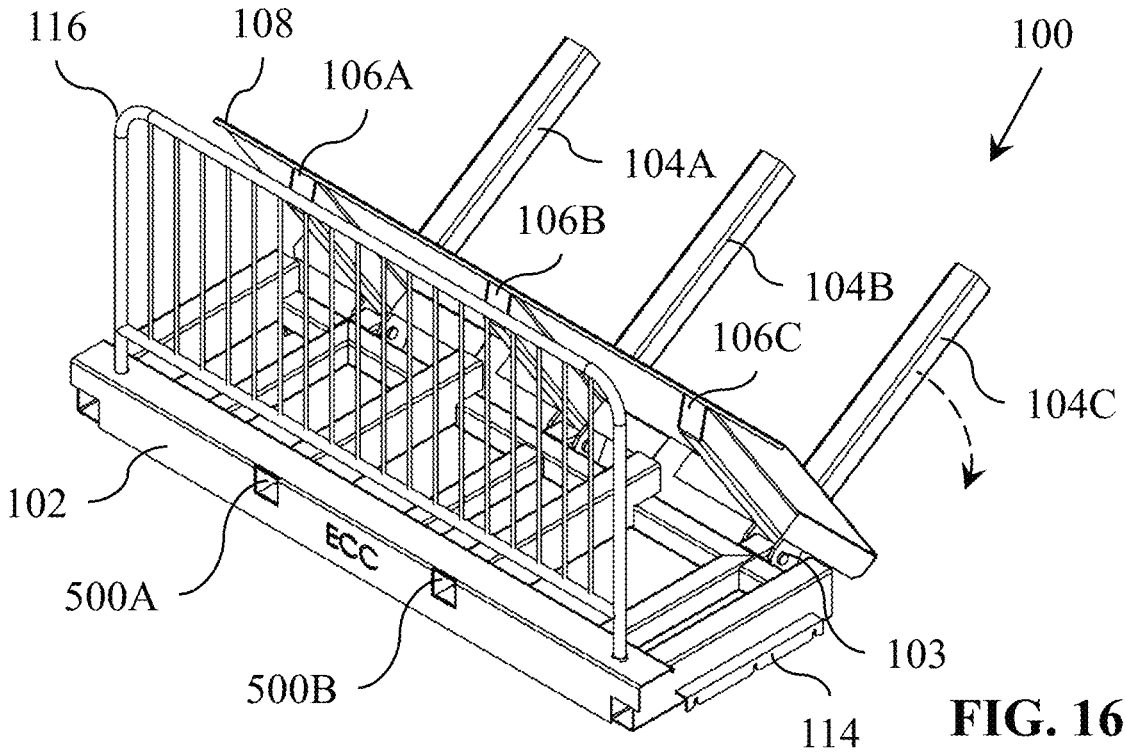
Figure 17:
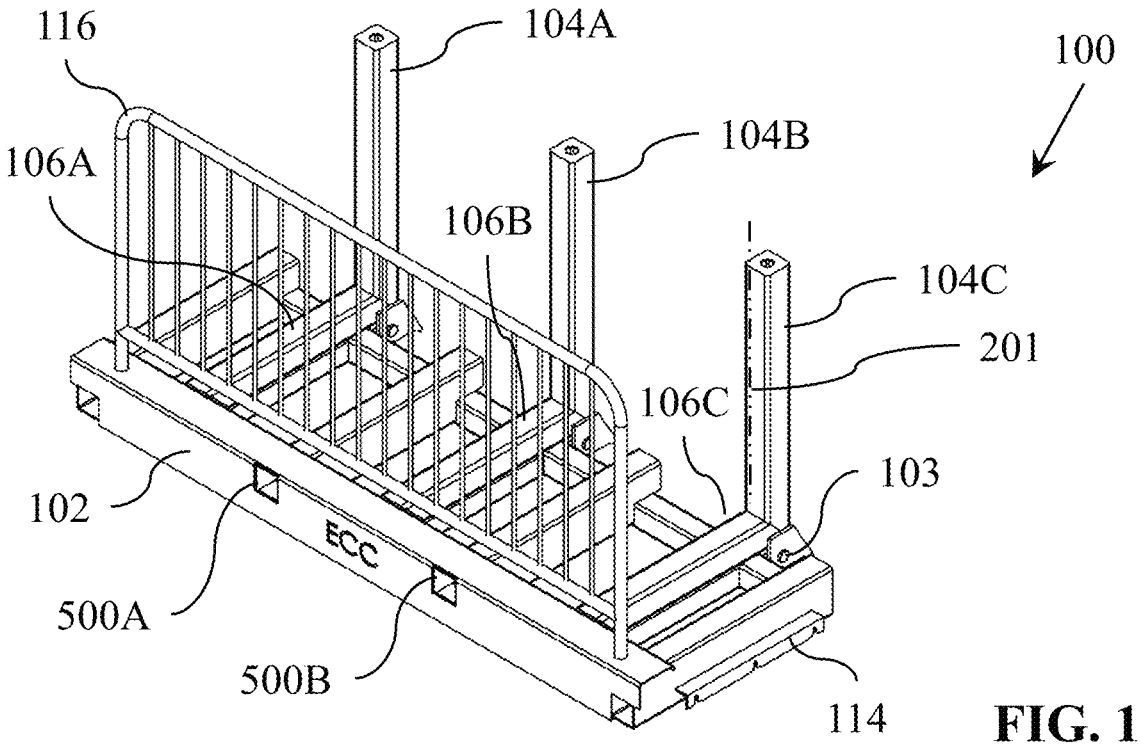
Figure 18:
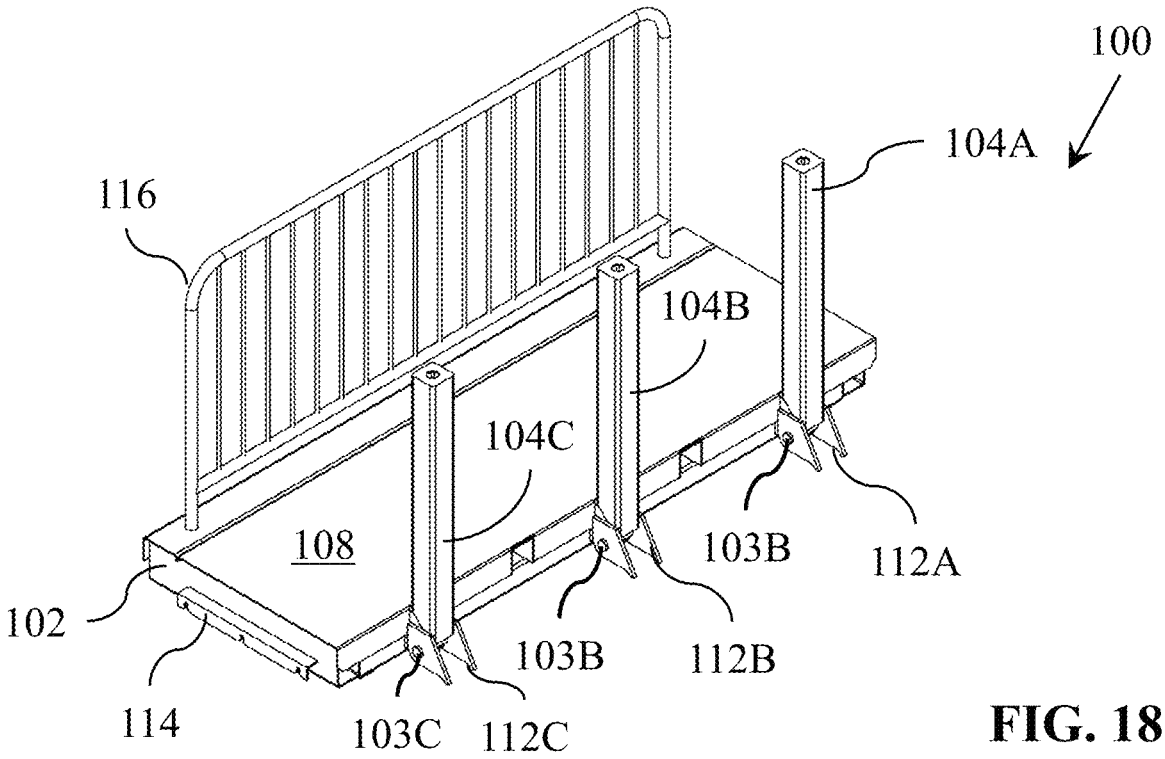
Figure 19:
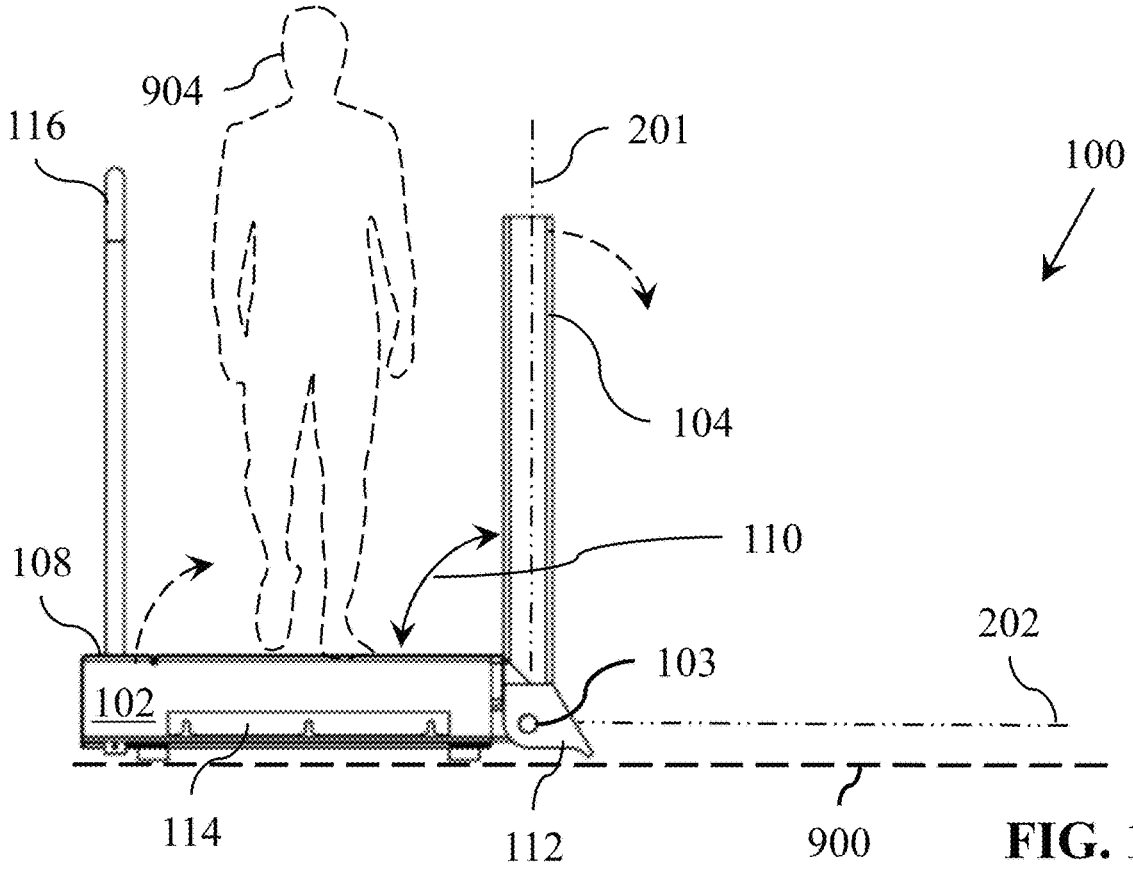
Figure 20:
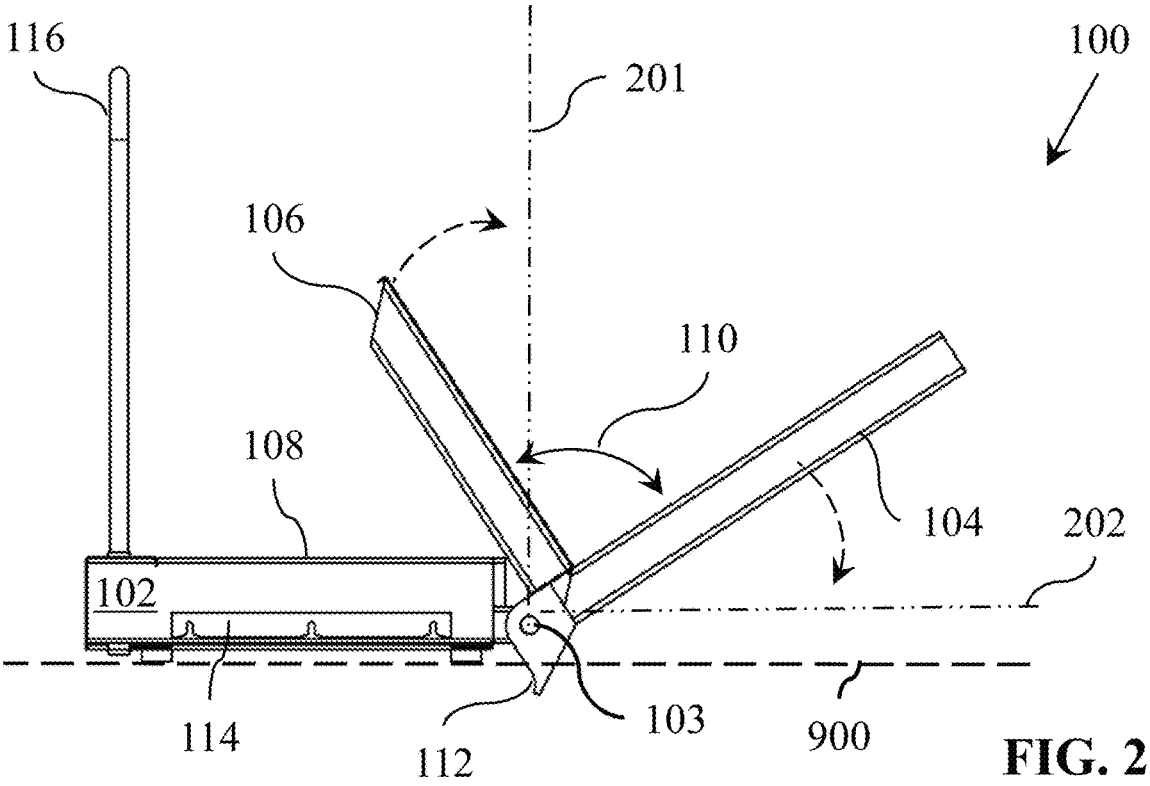
Figure 21:
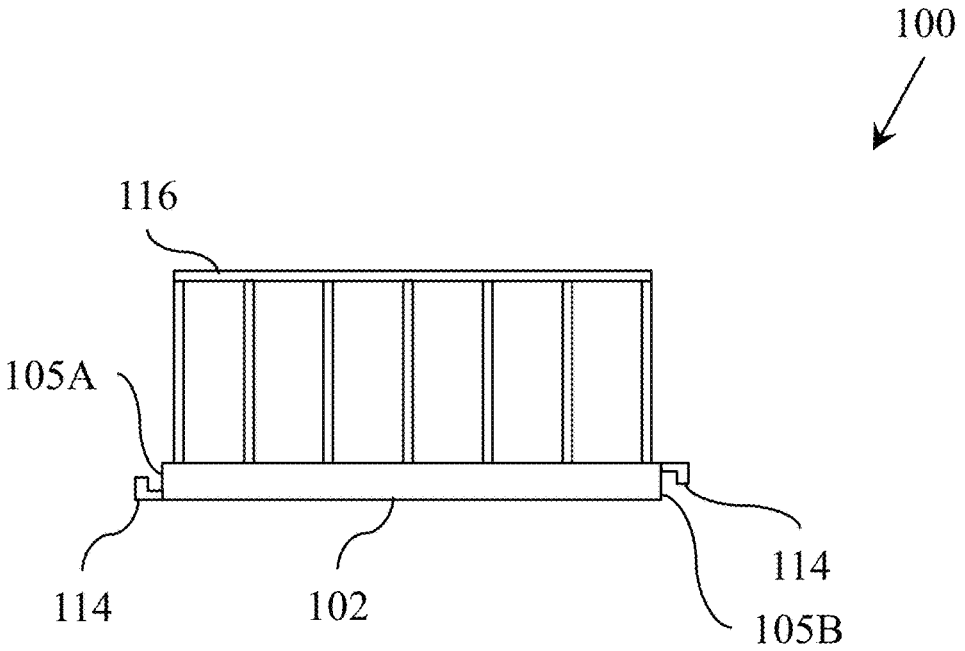
Figure 22:
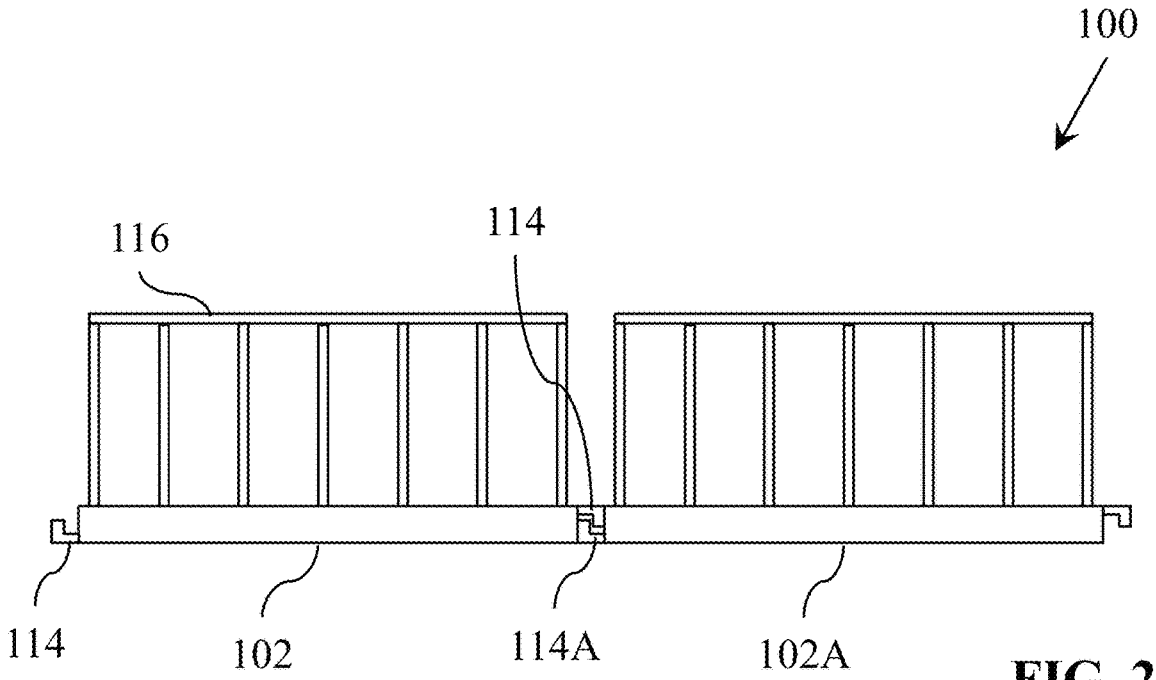
Figure 23:
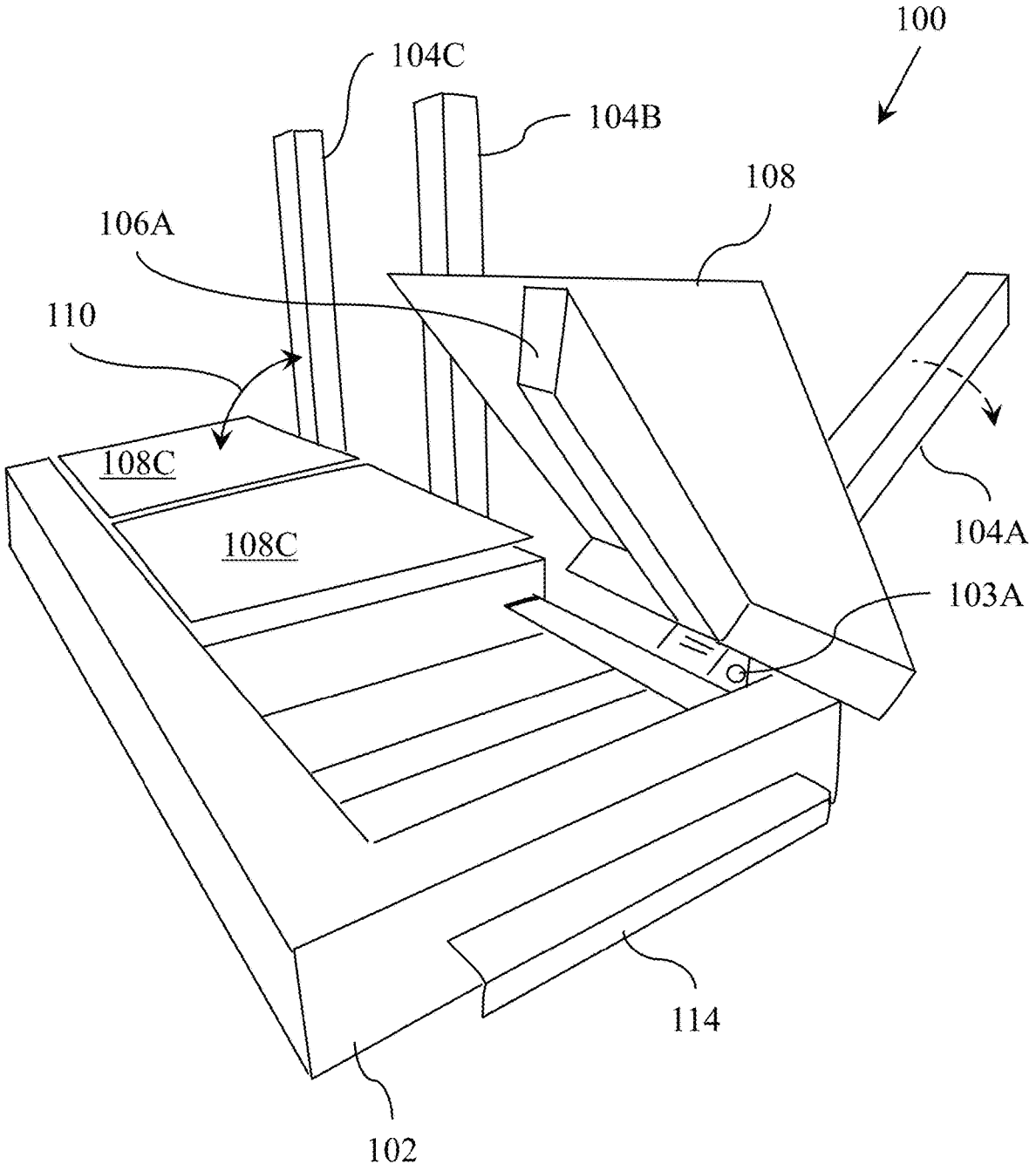
Figure 24:
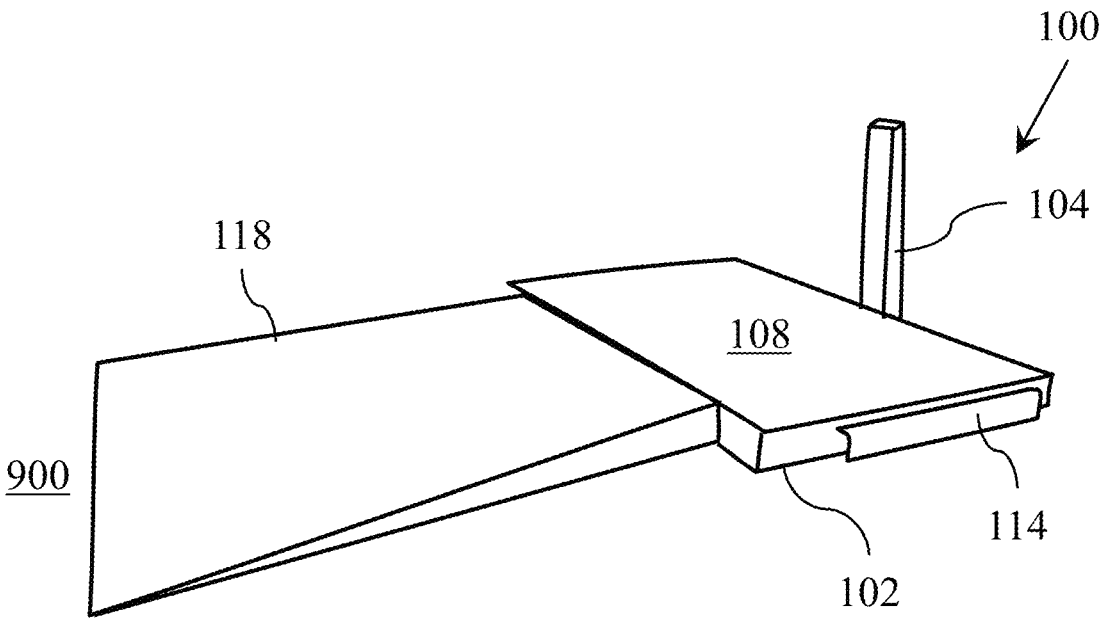
Figure 25:
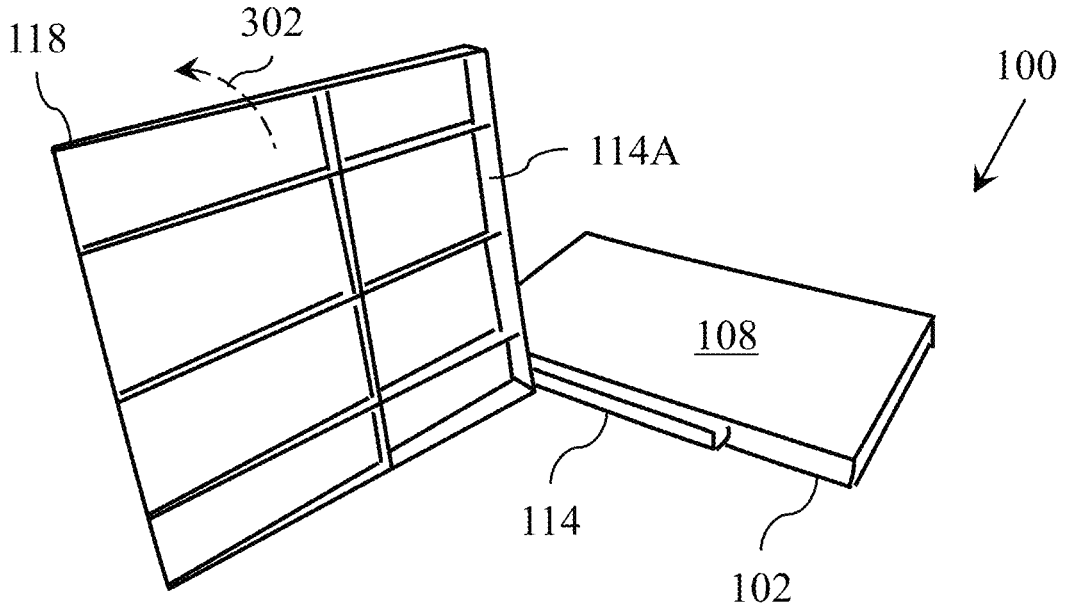
Figure 28:
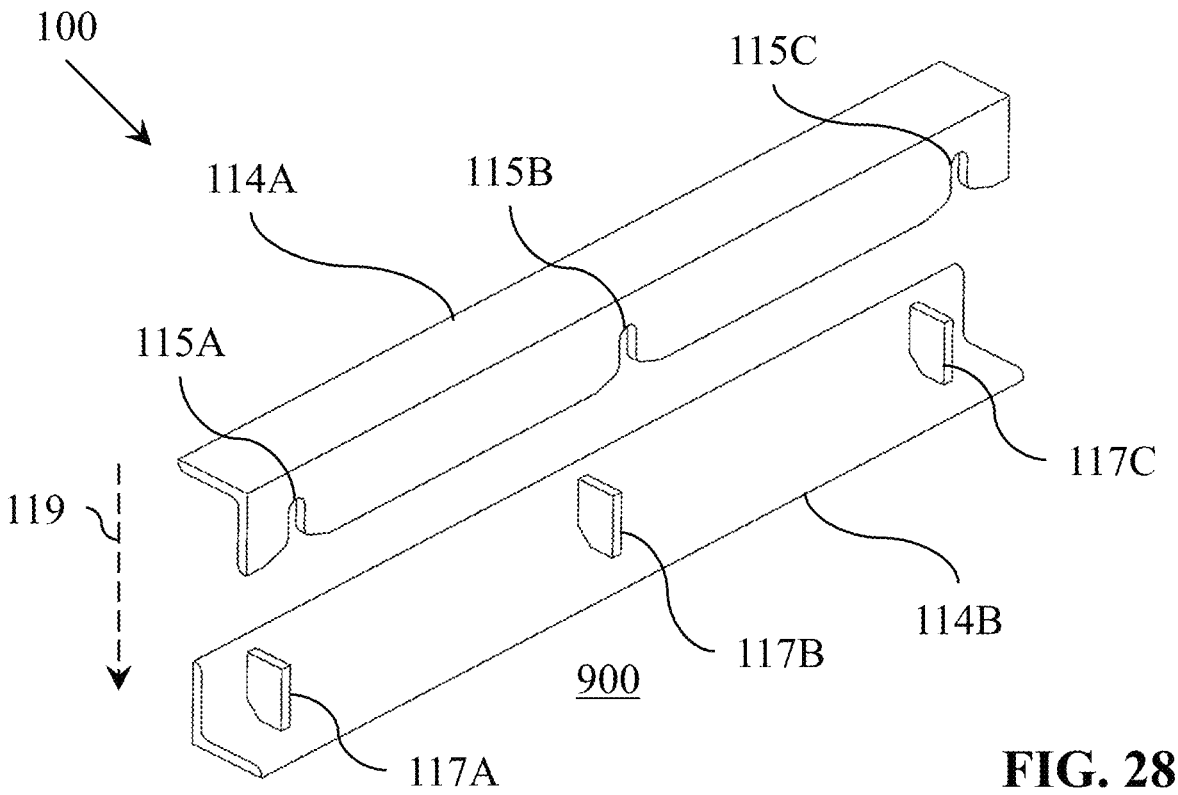
Figure 29:
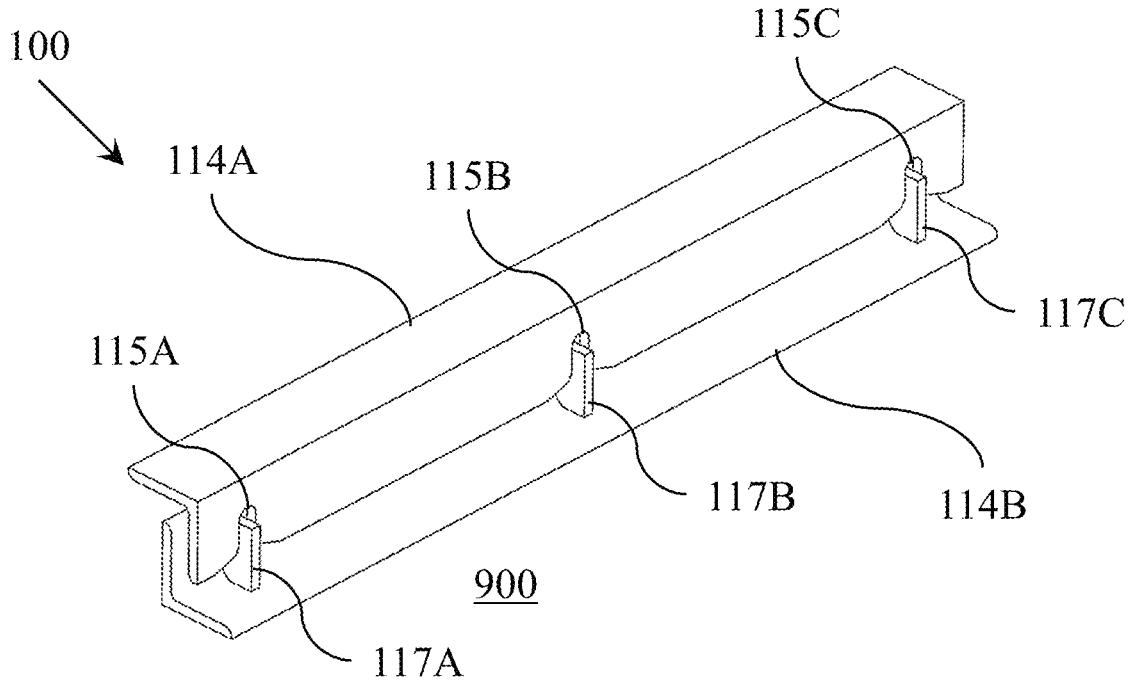

FIG. 28 and FIG. 29 depict perspective views of the embodiments of the apparatus 100 of FIG. 1.

Referring to the embodiment as depicted in FIG. 28, the first link structure 114A provides (includes) the spaced-apart notches (115A, 115B, 115C). The spaced-apart notches (115A, 115B, 115C) face downwardly toward the work surface 900 once the first base assembly 102A is placed on the work surface 900. The second link structure 114B includes (provides) the spaced-apart extension portions (117A, 117B, 117C). The spaced-apart extension portions (117A, 117B, 117C) face upwardly (once the second base assembly 102B is placed on the work surface 900 (also depicted in FIG. 27). The first link structure 114A is movable along the movement direction 119 so that the spaced-apart extension portions (117A, 117B, 117C) of the second link structure 114B are received (at least in part) into the spaced-apart notches (115A, 115B, 115C) of the first link structure 114A. Generally, the first link structure 114A and the second link structure 114B are configured to prevent the first base assembly 102A and the second base assembly 102B from moving laterally side to side (once mated accordingly with each other).

Figure 30:
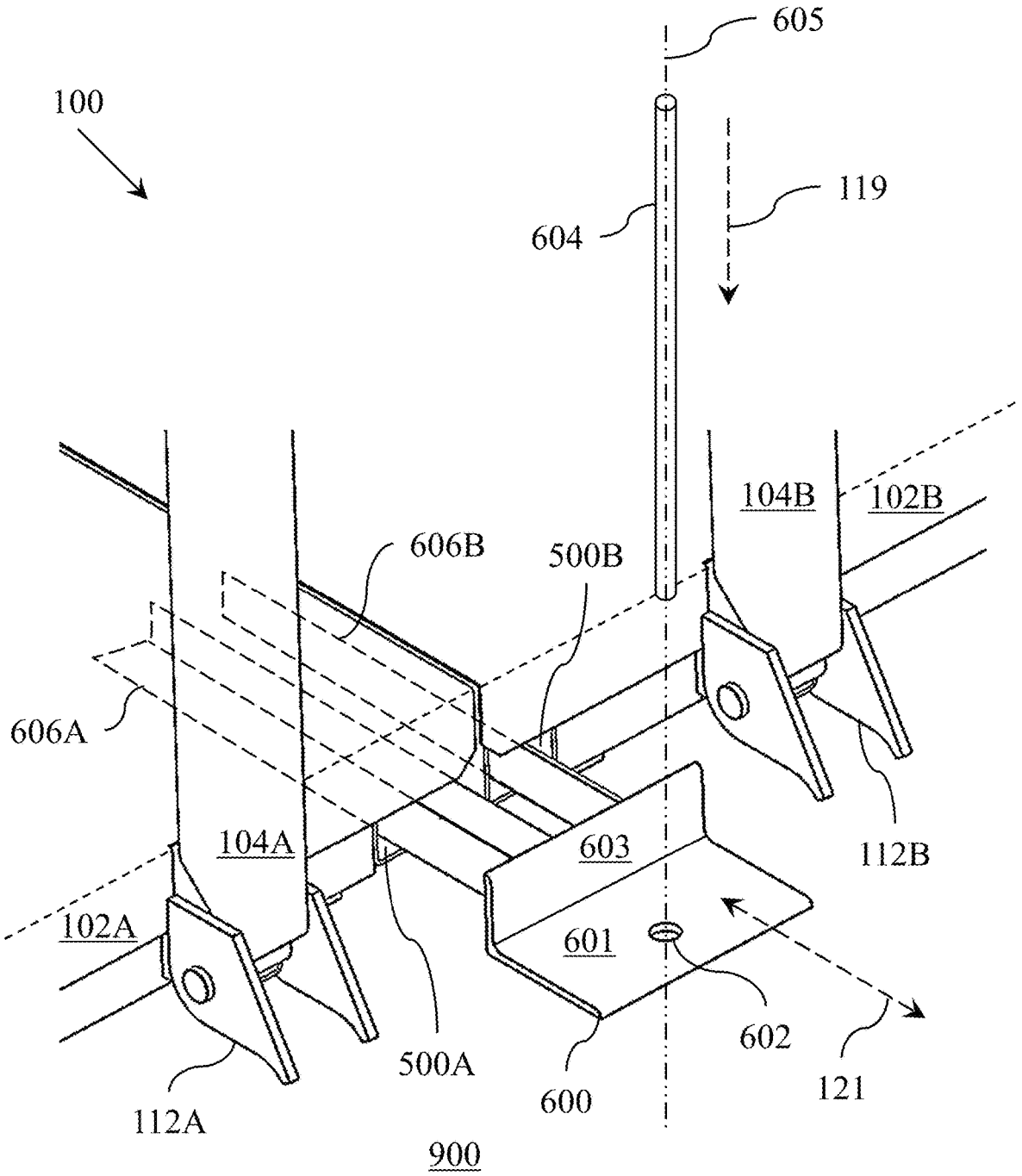

FIG. 30 depicts a perspective views of an embodiment of the apparatus 100 of FIG. 1.

Referring to the embodiment as depicted in FIG. 30, the first base assembly 102A and the second base assembly 102B are positioned in an end-to-end relationship (preferably, in an end-to-end abutment with each other while the first base assembly 102A and the second base assembly 102B are placed on the work surface 900). The first fork-lift feature 500A (of the first base assembly 102A) and the second fork-lift feature 500B (of the second base assembly 102B) are configured to be positioned in close proximity to each other (in a side-by-side relationship) once the first base assembly 102A and the second base assembly 102B are placed on the work surface 900. The first fork-lift feature 500A and the second fork-lift feature 500B are coaxially aligned with each other once the first base assembly 102A and the second base assembly 102B are positioned in an end-to-end relationship.

Referring to the embodiment as depicted in FIG. 30, the apparatus 100 further includes (and is not limited to), preferably, a lock device 600. The lock device 600 is configured to lock or secure the first base assembly 102A and/or the second base assembly 102B to the work surface 900. The lock device 600 includes a flat plate portion 601 that provides (defines) a lock hole 602 positioned in the center of the flat plate portion 601. The lock hole 602 extends through the flat plate portion 601. The flat plate portion 601 is configured to face the work surface 900.

Referring to the embodiment as depicted in FIG. 30, the lock device 600, preferably, also includes a stop portion 603. The stop portion 603 extends upwardly from the flat plate portion 601 (once the flat plate portion 601 faces the work surface 900). The stop portion 603 is configured to make contact with the peripheral lateral side edge of the first base assembly 102A (once the stop portion 603 is moved toward first base assembly 102A, along the direction 121). The stop portion 603 is configured to make contact with the peripheral lateral side edge of the second base assembly 102B (once the stop portion 603 is moved toward second base assembly 102B, along the direction 121).

Referring to the embodiment as depicted in FIG. 30, the lock device 600 also includes, preferably, an elongated stake 604. The elongated stake 604 has a longitudinal stake axis 605 extending therethrough. The elongated stake 604 is configured to be inserted into the lock hole 602 (the elongated stake 604 is movable along the movement direction 119). Once the flat plate portion 601 is positioned on the work surface 900, the elongated stake 604 is insertable into the lock hole 602, and into the work surface 900. The elongated stake 604 is configured to secure the end sections of the first base assembly 102A and the second base assembly 102B to the work surface 900 (once the elongated stake 604 is inserted into the lock hole 602).

Referring to the embodiment as depicted in FIG. 30, the lock device 600 also includes, preferably, a first extending member 606A and a second extending member 606B that is spaced apart from the first extending member 606A. The first extending member 606A and the second extending member 606B extend laterally from the stop portion 603 (toward the first base assembly 102A and the second base assembly 102B, respectively). The first extending member 606A is configured to be received (at least in part) into the first fork-lift feature 500A of the first base assembly 102A. The second extending member 606B is configured to be received (at least in part) into the second fork-lift feature 500B of the second base assembly 102B. The first extending member 606A and the second extending member 606B are movable along the direction 121 (movement direction) that is aligned parallel to the work surface 900. Once the first extending member 606A is received (at least in part) into the first fork-lift feature 500A, and once the second extending member 606B is received (at least in part) into the second fork-lift feature 500B, the elongated stake 604 is inserted into the elongated stake 604 and into the work surface 900 (so that in this manner, the lock device 600 securely connects the end sections of the first base assembly 102A and the second base assembly 102B to the work surface 900).

Referring to the embodiment as depicted in FIG. 30, the first extending member 606A includes, preferably, a first angled elongated L-shaped bracket. The second extending member 606B includes, preferably, a second angled elongated L-shaped bracket. The first and second angled elongated L-shaped brackets are configured to permit insertion of electrical cables (along the opposite sides of the first base assembly 102A and the second base assembly 102B). In this manner, the electrical cables (or utilities, such as plumbing, etc.) may extend between the opposite lateral sides of the first base assembly 102A and the second base assembly 102B. Generally, the first extending member 606A and the second extending member 606B are each configured to permit insertion of electrical cables that may extend between the opposite lateral sides of the first base assembly 102A and the second base assembly 102B.

Figure 31:
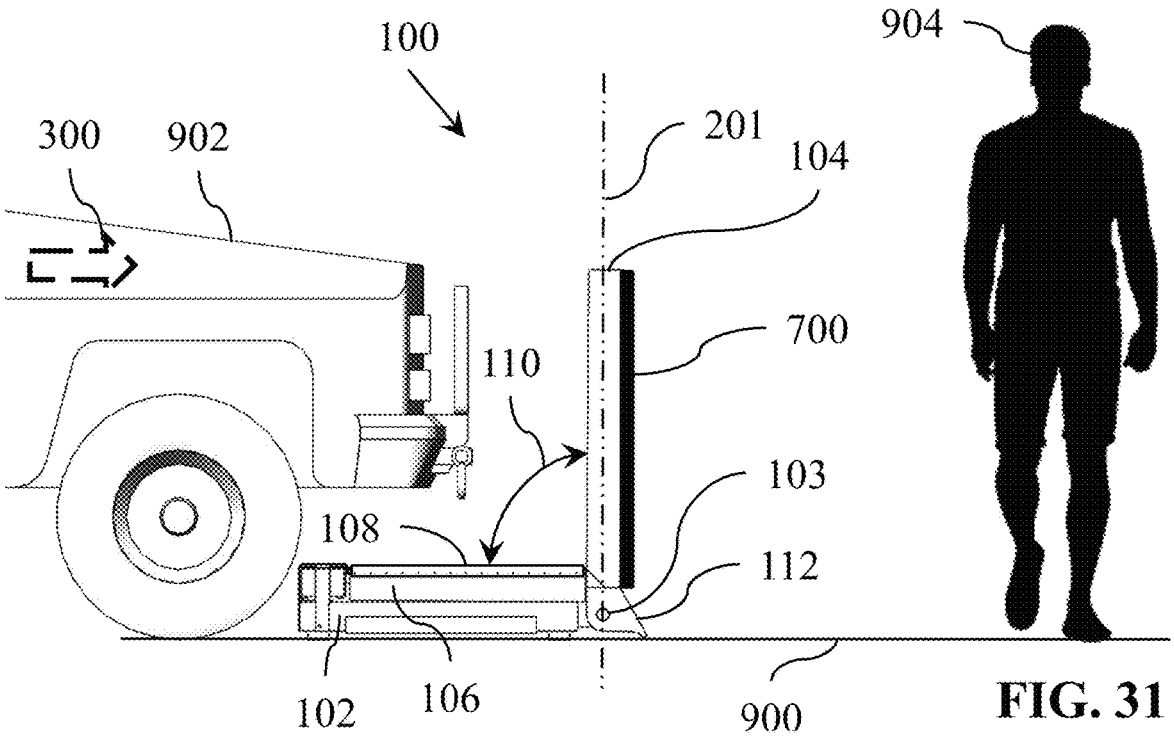
Figure 32:
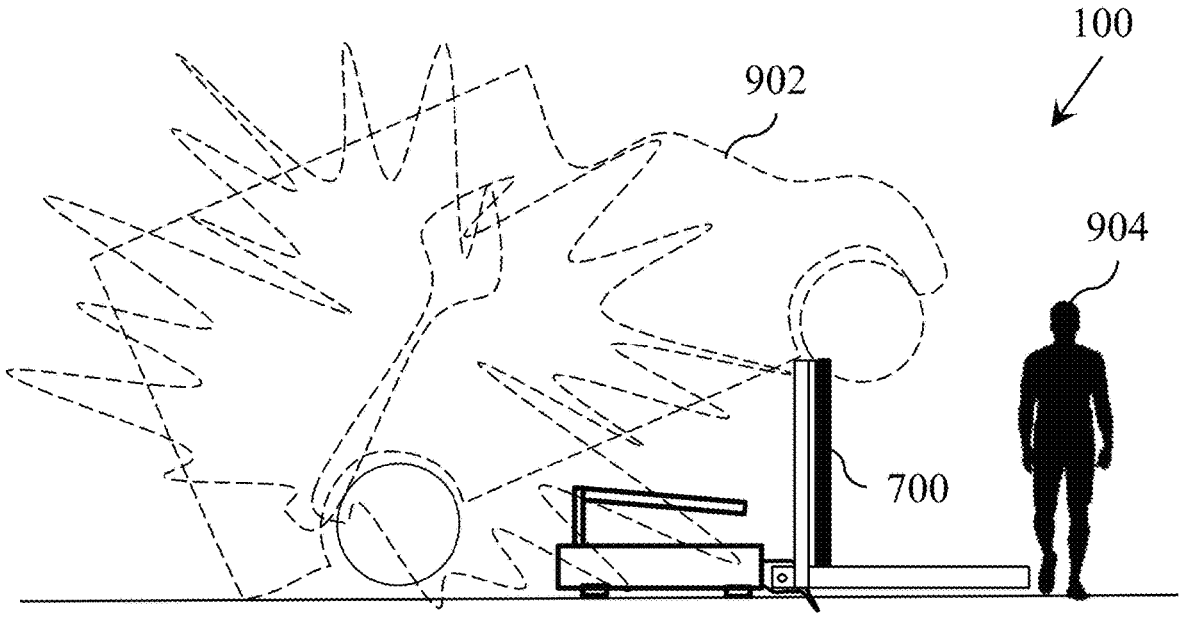

FIG. 31 and FIG. 32 depict side views of the embodiments of the apparatus 100 of FIG. 1.

Referring to the embodiments as depicted in FIG. 31 and FIG. 31, the first elongated member 104 further includes, preferably, a plate member 700. The first elongated member 104 is configured to be affixed to the plate member 700, and to support the weight of the plate member 700. The plate member 700 includes, preferably, a blast-proof metal alloy (a metal component that is not destructible) for bomb-blast protection.

The following is offered as further description of the embodiments, in which any one or more of any technical feature (described in the detailed description, the summary and the claims) may be combinable with any other one or more of any technical feature (described in the detailed description, the summary and the claims). It is understood that each claim in the claims section is an open ended claim unless stated otherwise. Unless otherwise specified, relational terms used in these specifications should be construed to include certain tolerances that the person skilled in the art would recognize as providing equivalent functionality. By way of example, the term perpendicular is not necessarily limited to 90.0 degrees, and may include a variation thereof that the person skilled in the art would recognize as providing equivalent functionality for the purposes described for the relevant member or element. Terms such as "about" and "substantially", in the context of configuration, relate generally to disposition, location, or configuration that are either exact or sufficiently close to the location, disposition, or configuration of the relevant element to preserve operability of the element within the invention which does not materially modify the invention. Similarly, unless specifically made clear from its context, numerical values should be construed to include certain tolerances that the person skilled in the art would recognize as having negligible importance as they do not materially change the operability of the invention. It will be appreciated that the description and/or drawings identify and describe embodiments of the apparatus (either explicitly or inherently). The apparatus may include any suitable combination and/or permutation of the technical features as identified in the detailed description, as may be required and/or desired to suit a particular technical purpose and/or technical function. It will be appreciated that, where possible and suitable, any one or more of the technical features of the apparatus may be combined with any other one or more of the technical features of the apparatus (in any combination and/or permutation). It will be appreciated that persons skilled in the art would know that the technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help to understand the scope of the claims. It is believed that all the crucial aspects of the disclosed subject matter have been provided in this document. It is understood, for this document, that the word "includes" is equivalent to the word "comprising" in that both words are used to signify an open-ended listing of assemblies, components, parts, etc. The term "comprising", which is synonymous with the terms "including," "containing," or "characterized by," is inclusive or open-ended and does not exclude additional, unrecited elements or method steps. Comprising (comprised of) is an "open" phrase and allows coverage of technologies that employ additional, unrecited elements. When used in a claim, the word "comprising" is the transitory verb (transitional term) that separates the preamble of the claim from the technical features of the invention. The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a base assembly being positionable on a work surface; and a first elongated member being pivotally coupled to the base assembly; and the first elongated member being pivotally movable relative to the base assembly, from a first alignment toward a second alignment once the first elongated member is pivotally coupled to the base assembly, and once a vehicle moves toward and strikes the first elongated member, which is positioned in the first alignment, and urges pivotal movement of the first elongated member toward the second alignment; and a second elongated member being affixed to, and extending from, the first elongated member, and the second elongated member and the first elongated member defining an angle subtended therebetween; and the second elongated member pivotally moving, relative to the base assembly, and intimately contacting the vehicle, and hindering, at least in part, movement of the vehicle over and past the base assembly once the vehicle moves toward and strikes and pivotally moves the first elongated member from the first alignment toward the second alignment with a weight of the vehicle being received, at least in part, by the base assembly, in which movement of the first elongated member, from the first alignment toward the second alignment, urges the second elongated member to pivotally move, relative to the base assembly, and intimately contact an underside of the vehicle, which is moving, in such a way that the second elongated member hinders, at least in part, movement of the vehicle over and past the base assembly, with the weight of the vehicle being received, at least in part, by the base assembly once the vehicle is halted by the second elongated member; and a plate assembly being affixed to, and extending from, a lateral elongated side of the second elongated member, and the plate assembly being supportive of pedestrian weight thereon once the plate assembly is positioned coplanar relative to the work surface; and the plate assembly includes a sacrificial portion configured to be torn from the plate assembly in response to a wheel of the vehicle striking the plate assembly.

2. The apparatus of claim 1, further comprising:

a plate assembly being affixed to, and extending from, a lateral elongated side of the second elongated member, and the plate assembly shielding, at least in part, a pedestrian once the pedestrian is positioned proximate to the first elongated member and once the second elongated member and the underside of the vehicle intimately contact each other.

3. The apparatus of claim 1, further comprising:

a claw device extending from the first elongated member; and the claw device being configured to dig into the work surface in response to the vehicle striking and pivotally moving the first elongated member toward the second alignment; and the claw device is configured to be made to dig into the work surface as the first elongated member is pivotally rotated.

4. The apparatus of claim 1, wherein:

the angle is about 90 degrees.

5. The apparatus of claim 1, further comprising:

a pivotal connection being affixed to an edge section of the base assembly; and wherein the first elongated member is pivotally coupled to the pivotal connection.

6. The apparatus of claim 1, wherein:

the first alignment includes a vertical alignment relative to the work surface; and the second alignment includes a horizontal alignment relative to the work surface.

7. The apparatus of claim 1, further comprising:

a link structure being positioned along an edge portion of the base assembly; and the link structure being configured to facilitate a selective linked connection with a corresponding link structure of an adjacently-positioned base assembly.

8. The apparatus of claim 1, further comprising:

an access ramp being configured to be placed in an abutment relationship to an edge portion of the base assembly; and the access ramp is configured to be connectable to the edge portion of the base assembly; and the access ramp having a wedge-shaped profile.

9. The apparatus of claim 1, wherein:

the plate assembly extends from, and beyond, opposite lateral sides of the first elongated member.

10. The apparatus of claim 1, wherein:

the second elongated member is positioned under, and is affixed to, the plate assembly; and the second elongated member supports the plate assembly and a pedestrian weight.

11. The apparatus of claim 1, wherein:

in the first alignment, the plate assembly and the base assembly are pivotally separated from each other.

12. The apparatus of claim 1, wherein:

in the second alignment, the plate assembly and the base assembly are coplanar with each other.

13. The apparatus of claim 1, wherein:

the plate assembly is configured to be partially crumpled by the wheels of the vehicle.

14. The apparatus of claim 1, wherein:

the plate assembly has a lateral span being wider than the lateral span of the first elongated member; and the plate assembly extends between opposite lateral sides of the base assembly; and the plate assembly extends between, and covers, the opposite lateral sides of the base assembly.

15. The apparatus of claim 1, wherein:

the plate assembly includes a non-slip surface being configured to improve walking safety of a pedestrian along thereon.

16. The apparatus of claim 1, further comprising:

a pedestrian barricade including a plurality of vertically-extending posts arranged or positioned one after the other along a row, with a horizontally-extending hand rail connected to distal end portions of the plurality of vertically-extending posts; and the pedestrian barricade being configured to be affixed to, and extend upwardly from, a top surface of the plate assembly once the plate assembly.

17. The apparatus of claim 1, wherein:

the base assembly is configured to pivotally connect with a plurality of first elongated members all of which are connected to the plate assembly; and the plurality of first elongated members are pivotally movable together in unison relative to the base assembly; and the plurality of first elongated members are utilized for the movement of the plate assembly.

18. The apparatus of claim 1, wherein:

the base assembly is configured to accommodate a plurality of first elongated members each being independently pivotally movable relative to each other; and the base assembly is configured to pivotally connect with the plurality of first elongated members all of which are affixed to respective plate assemblies.

19. An apparatus, comprising:

a base assembly being positionable on a work surface; and a first elongated member being pivotally coupled to the base assembly; and the first elongated member being pivotally movable relative to the base assembly, from a first alignment toward a second alignment once the first elongated member is pivotally coupled to the base assembly, and once a vehicle moves toward and strikes the first elongated member, which is positioned in the first alignment, and urges pivotal movement of the first elongated member toward the second alignment; and a second elongated member being affixed to, and extending from, the first elongated member, and the second elongated member and the first elongated member defining an angle subtended therebetween; and the second elongated member pivotally moving, relative to the base assembly, and intimately contacting the vehicle, and hindering, at least in part, movement of the vehicle over and past the base assembly once the vehicle moves toward and strikes and pivotally moves the first elongated member from the first alignment toward the second alignment with a weight of the vehicle being received, at least in part, by the base assembly, in which movement of the first elongated member, from the first alignment toward the second alignment, urges the second elongated member to pivotally move, relative to the base assembly, and intimately contact an underside of the vehicle, which is moving, in such a way that the second elongated member hinders, at least in part, movement of the vehicle over and past the base assembly, with the weight of the vehicle being received, at least in part, by the base assembly once the vehicle is halted by the second elongated member; and a plate assembly being affixed to, and extending from, a lateral elongated side of the second elongated member, and the plate assembly being supportive of pedestrian weight thereon once the plate assembly is positioned coplanar relative to the work surface; and the plate assembly is configured to be partially crumpled by the wheels of the vehicle.

20. The apparatus of claim 19, wherein:

the plate assembly includes a non-slip surface being configured to improve walking safety of a pedestrian along thereon.

21. The apparatus of claim 19, wherein:

the base assembly is configured to accommodate a plurality of first elongated members each being independently pivotally movable relative to each other; and the base assembly is configured to pivotally connect with the plurality of first elongated members all of which are affixed to respective plate assemblies.

22. An apparatus, comprising:

a base assembly being positionable on a work surface; and a first elongated member being pivotally coupled to the base assembly; and the first elongated member being pivotally movable relative to the base assembly, from a first alignment toward a second alignment once the first elongated member is pivotally coupled to the base assembly, and once a vehicle moves toward and strikes the first elongated member, which is positioned in the first alignment, and urges pivotal movement of the first elongated member toward the second alignment; and a second elongated member being affixed to, and extending from, the first elongated member, and the second elongated member and the first elongated member defining an angle subtended therebetween; and the second elongated member pivotally moving, relative to the base assembly, and intimately contacting the vehicle, and hindering, at least in part, movement of the vehicle over and past the base assembly once the vehicle moves toward and strikes and pivotally moves the first elongated member from the first alignment toward the second alignment with a weight of the vehicle being received, at least in part, by the base assembly, in which movement of the first elongated member, from the first alignment toward the second alignment, urges the second elongated member to pivotally move, relative to the base assembly, and intimately contact an underside of the vehicle, which is moving, in such a way that the second elongated member hinders, at least in part, movement of the vehicle over and past the base assembly, with the weight of the vehicle being received, at least in part, by the base assembly once the vehicle is halted by the second elongated member; and a plate assembly being affixed to, and extending from, a lateral elongated side of the second elongated member, and the plate assembly being supportive of pedestrian weight thereon once the plate assembly is positioned coplanar relative to the work surface; and the plate assembly includes a non-slip surface being configured to improve walking safety of a pedestrian along thereon.

23. The apparatus of claim 22, wherein:

the base assembly is configured to accommodate a plurality of first elongated members each being independently pivotally movable relative to each other; and the base assembly is configured to pivotally connect with the plurality of first elongated members all of which are affixed to respective plate assemblies.

24. An apparatus, comprising:

a base assembly being positionable on a work surface; and a first elongated member being pivotally coupled to the base assembly; and the first elongated member being pivotally movable relative to the base assembly, from a first alignment toward a second alignment once the first elongated member is pivotally coupled to the base assembly, and once a vehicle moves toward and strikes the first elongated member, which is positioned in the first alignment, and urges pivotal movement of the first elongated member toward the second alignment; and a second elongated member being affixed to, and extending from, the first elongated member, and the second elongated member and the first elongated member defining an angle subtended therebetween; and the second elongated member pivotally moving, relative to the base assembly, and intimately contacting the vehicle, and hindering, at least in part, movement of the vehicle over and past the base assembly once the vehicle moves toward and strikes and pivotally moves the first elongated member from the first alignment toward the second alignment with a weight of the vehicle being received, at least in part, by the base assembly, in which movement of the first elongated member, from the first alignment toward the second alignment, urges the second elongated member to pivotally move, relative to the base assembly, and intimately contact an underside of the vehicle, which is moving, in such a way that the second elongated member hinders, at least in part, movement of the vehicle over and past the base assembly, with the weight of the vehicle being received, at least in part, by the base assembly once the vehicle is halted by the second elongated member; and a plate assembly being affixed to, and extending from, a lateral elongated side of the second elongated member, and the plate assembly being supportive of pedestrian weight thereon once the plate assembly is positioned coplanar relative to the work surface; and the base assembly is configured to accommodate a plurality of first elongated members each being independently pivotally movable relative to each other; and the base assembly is configured to pivotally connect with the plurality of first elongated members all of which are affixed to respective plate assemblies.

* * * * *